US009163429B2

(12) United States Patent
Takenaka et al.

(10) Patent No.: US 9,163,429 B2
(45) Date of Patent: Oct. 20, 2015

(54) IMAGE FORMING APPARATUS HAVING DRAWER UNIT

(71) Applicants: Kohta Takenaka, Kanagawa (JP); Joh Ebara, Kanagawa (JP); Hiroshi Ishii, Kanagawa (JP); Junichi Kawase, Kanagawa (JP); Tetsuji Nishikawa, Tokyo (JP); Yoshihide Ohta, Kanagawa (JP); Kohta Hirakawa, Tokyo (JP); Toshihiro Shimada, Kanagawa (JP); Yusuke Funayama, Kanagawa (JP); Tsuyoshi Endo, Kanagawa (JP)

(72) Inventors: Kohta Takenaka, Kanagawa (JP); Joh Ebara, Kanagawa (JP); Hiroshi Ishii, Kanagawa (JP); Junichi Kawase, Kanagawa (JP); Tetsuji Nishikawa, Tokyo (JP); Yoshihide Ohta, Kanagawa (JP); Kohta Hirakawa, Tokyo (JP); Toshihiro Shimada, Kanagawa (JP); Yusuke Funayama, Kanagawa (JP); Tsuyoshi Endo, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 14 days.

(21) Appl. No.: 14/104,427

(22) Filed: Dec. 12, 2013

(65) Prior Publication Data

US 2014/0167587 A1 Jun. 19, 2014

(30) Foreign Application Priority Data

Dec. 13, 2012 (JP) ..... 2012-272878

(51) Int. Cl.

| | |
|---|---|
| ***G03G 21/00*** | (2006.01) |
| ***E05B 65/44*** | (2006.01) |
| ***G03G 21/16*** | (2006.01) |
| ***G03G 15/00*** | (2006.01) |

(52) U.S. Cl.

CPC ..... *E05B 65/44* (2013.01); *G03G 15/6502* (2013.01); *G03G 21/1633* (2013.01); *G03G 21/1647* (2013.01); *G03G 2221/1654* (2013.01); *G03G 2221/1684* (2013.01)

(58) Field of Classification Search

CPC ..... G03G 15/6502; G03G 15/6511; G03G 21/1633; G03G 21/1638; G03G 21/1647; G03G 21/1695; G03G 2215/00383; G03G 2215/00544; G03G 2221/1654; G03G 2221/1684; E05B 65/44

USPC ..... 399/110, 124, 393, 402

See application file for complete search history.

(56) References Cited

U.S. PATENT DOCUMENTS

| | | | | |
|---|---|---|---|---|
| 5,134,443 | A * | 7/1992 | Sumi et al. | 399/121 |
| 5,307,116 | A * | 4/1994 | Ikunami et al. | 399/18 |
| 5,854,965 | A * | 12/1998 | Kasiwabara et al. | 399/381 |
| 6,722,647 | B2 * | 4/2004 | Kato et al. | 271/3.03 |
| 7,657,204 | B2 * | 2/2010 | Yang | 399/107 |
| 7,831,190 | B2 * | 11/2010 | Yang | 399/360 |

(Continued)

FOREIGN PATENT DOCUMENTS

| | | | |
|---|---|---|---|
| JP | 08119494 | A * | 5/1996 |
| JP | 09309629 | A * | 12/1997 |
| JP | 2000-071558 | | 3/2000 |

(Continued)

*Primary Examiner* — Robert Beatty

(74) *Attorney, Agent, or Firm* — Harness, Dickey & Pierce

(57) ABSTRACT

An image forming apparatus includes a drawer unit configured to be drawn out from a body of the image forming apparatus. The drawer unit includes a carriage path for carrying a recording medium, a lock unit configured to lock the drawer unit in the body, a driving unit configured to drive the lock unit, the driving unit including at least a driving source, and a drawer unit cover configured to cover at least the drawer unit. The drawer unit cover is a part of an outer cover of the body arranged on a side in a drawing direction of the drawer unit. The drawer unit cover is attached to the drawer unit so that the drawer unit cover is removed from the drawer unit in a state where the drawer unit is attached to the body.

11 Claims, 28 Drawing Sheets

(56) References Cited

U.S. PATENT DOCUMENTS

| | | | | |
|---|---|---|---|---|
| 2006/0038408 | A1* | 2/2006 | Yamaguchi et al. | 292/101 |
| 2014/0167580 | A1* | 6/2014 | Funayama et al. | 312/237 |
| 2014/0328606 | A1* | 11/2014 | Katsuyama | 399/92 |

FOREIGN PATENT DOCUMENTS

| | | | | |
|---|---|---|---|---|
| JP | 2006-145892 | | | 6/2006 |
| JP | 2008077077 | A | * | 4/2008 |
| JP | 2008120502 | A | * | 5/2008 |

* cited by examiner

IMAGE FORMING APPARATUS HAVING DRAWER UNIT

CROSS-REFERENCE TO RELATED APPLICATION

The present application claims priority to and incorporates by reference the entire contents of Japanese Patent Application No. 2012-272878 filed in Japan on Dec. 13, 2012.

BACKGROUND OF THE INVENTION

1. Field of the Invention

The present invention relates to an image forming apparatus, such as a printer, a facsimile, and a copier.

2. Description of the Related Art

In general, in an image forming apparatus in which an electrostatic photographic process is utilized, a sheet of paper as a recording medium contained in a sheet feeding unit is carried to an image forming unit through a sheet feeding carriage path, and a toner image formed by the image forming unit is transferred. The sheet of paper on which the toner image is transferred is carried to a fixing apparatus, and the toner image on the sheet of paper is fixed. The sheet of paper with the fixed toner image is carried to a sheet discharge tray through a sheet discharge path, or carried to a reversing carriage path. The sheet of paper carried to the reversing carriage path is reversed, and carried to the image forming unit again, thereby the toner image on the back surface of the sheet of paper is transferred.

Japanese Patent No. 4484210 discloses an image forming apparatus which includes a drawer unit. The drawer unit contains the above-described sheet feeding carriage path, the above-described fixing apparatus, the above-described reversing carriage path, and the above-described sheet discharge path. The drawer unit can be drawn out from the image forming apparatus body. When a jam occurs in the carriage path contained in the above-described drawer unit, the drawer unit is drawn out from the apparatus body, thereby easily removing the sheet of paper therefrom.

In the image forming apparatus disclosed in Japanese Patent No. 4484210, when drawing out the drawer unit from the apparatus body, it is drawn out in accordance with the following procedure. First, the front cover is opened to expose the drawer unit. Next, the lock is released by operating a lock lever locking the drawer unit in the apparatus body, to draw out the drawer unit. Accordingly, in the image forming apparatus disclosed in Japanese Patent No. 4484210, it is necessary that the front cover is opened and the lock lever is operated, to draw out the drawer unit. Thus, many operations are required for drawing out the drawer unit, resulting in a problem of decreasing the work efficiency.

The applicant of the present invention has worked the following image forming apparatus under development. That is, it is an image forming apparatus in which a front cover as an outer cover is fixed to a drawer unit, and in which the drawer unit locked in the apparatus body is automatically unlocked using a motor as a driving source.

In the image forming apparatus under development, if a jam occurs in a carriage path of the drawer unit, the drawer unit is automatically unlocked by driving a motor provided in the drawer unit. When a user removes a sheet of paper in the carriage path of the drawer unit, the front cover is drawn out toward the front, thereby drawing out the drawer unit. Accordingly, in the image forming apparatus under development, when the user draws out the drawer unit, only an operation for drawing out the front cover is necessary. Thus, as compared to the image forming apparatus disclosed in Japanese Patent No. 4484210, an easier operation is necessary for drawing out the drawer unit. This results in enhancing the work efficiency for a jam process.

However, in the image forming apparatus under development, the drawer unit is not possibly drawn out from the apparatus body, if the motor unlocking the drawer unit is damaged. As a result, the drawer unit is not possibly exposed, causing another problem that it is very difficult to replace the damaged motor.

Therefore, there is a need to provide an image forming apparatus, in which a drawer unit can be drawn out with an easy operation, and a damaged driving source can easily be replaced even if the drawer unit is not possibly drawn out due to the damaged driving source.

SUMMARY OF THE INVENTION

It is an object of the present invention to at least partially solve the problem in the conventional technology.

According to an embodiment, an image forming apparatus that includes a drawer unit configured to be drawn out from a body of the image forming apparatus. The drawer unit includes a carriage path for carrying a recording medium, a lock unit configured to lock the drawer unit in the body, a driving unit configured to drive the lock unit, the driving unit including at least a driving source, and a drawer unit cover configured to cover at least the drawer unit. The drawer unit cover is a part of an outer cover of the body arranged on a side in a drawing direction of the drawer unit. The drawer unit cover is attached to the drawer unit so that the drawer unit cover is removed from the drawer unit in a state where the drawer unit is attached to the body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Descriptions will now be made to an image forming apparatus 1 according to an embodiment of the present invention, with reference to FIG. 1. In this embodiment, the image forming apparatus 1 is a tandem color copying machine.

Figure 1:
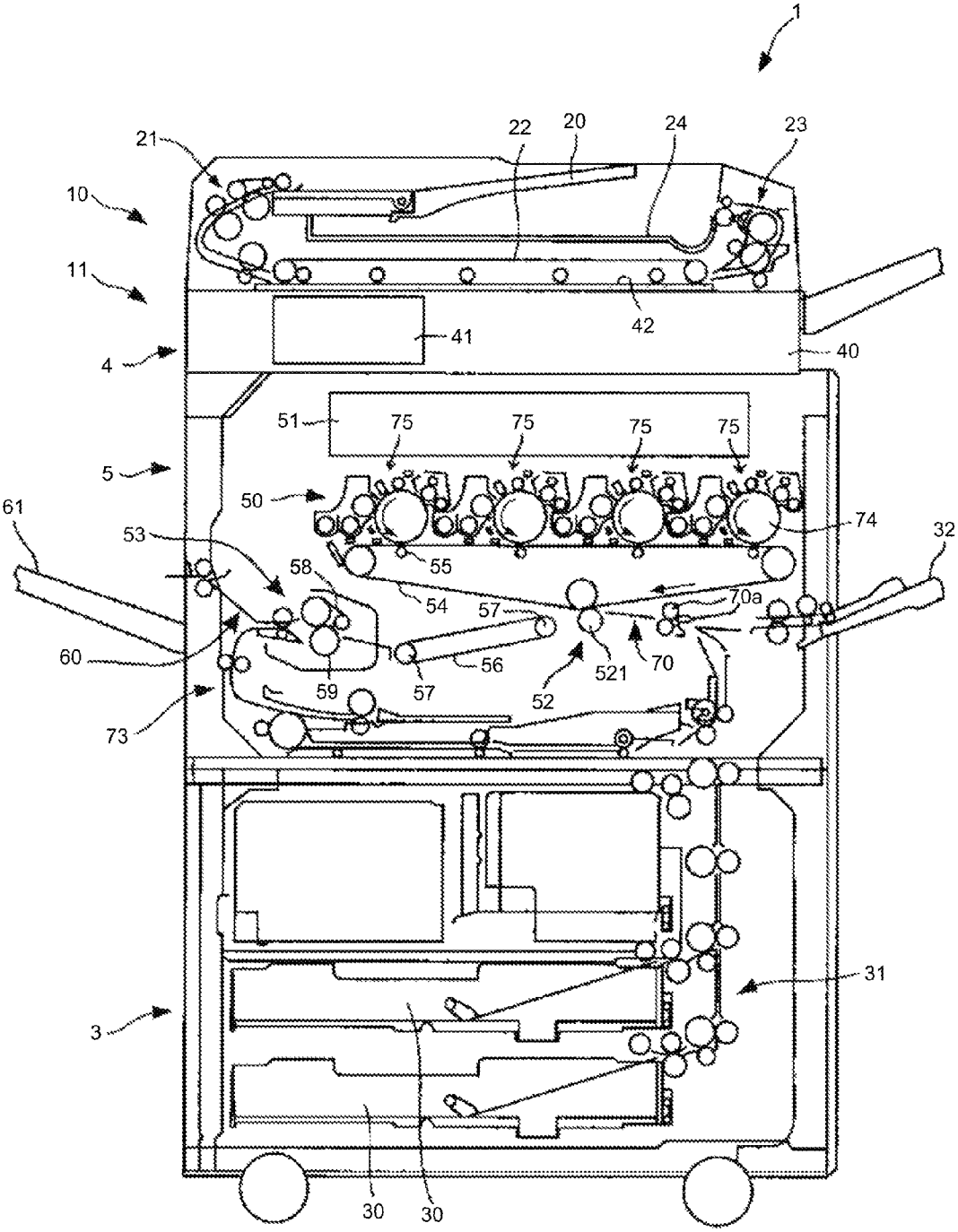
FIG. 1 is a schematic block diagram of an image forming apparatus according to an embodiment.

As illustrated in FIG. 1, the image forming apparatus 1 includes an automatic document feeder (hereinafter referred to as an ADF) 10 and an image forming apparatus body 11. The image forming apparatus body 11 includes a sheet feeding unit 3, an image reading unit 4, and an apparatus body unit 5.

The ADF 10 includes a document tray 20, a document feeding roller 21, a document carriage belt 22, a document discharge roller 23, and a document discharge tray 24. The ADF 10 is attached to the image reading unit 4, openably/closably through an opening/closing mechanism (not illustrated), such as a hinge.

The document feeding roller 21 separates the document from a bunch of documents (not illustrated), one by one, put on the document tray 20, and carries them toward the image reading unit 4. The document carrier belt 22 carries the document separated by the document feeding roller 21 to the image reading unit 4. The document discharge roller 23 discharges the document discharged by the document carrier belt 22 from the image reading unit 4, to the document discharge tray 24 below the document tray 20.

The image reading unit 4 includes a casing 40, a scanning optical unit 41, a contact glass 42, and a driving unit (not illustrated).

The scanning optical unit 41 is provided inside the casing 40, and includes an LED unit. The scanning optical unit 41 irradiates a ray of light from the LED unit in a main-scanning direction, and is scanned by the driving unit in a sub-scanning direction in the entire irradiation area. As a result, the scanning optical unit 41 reads a two-dimensional color image of the document.

The contact glass 42 is provided on the upper part of the casing 40 of the image reading unit 4, and is included in the upper surface of the casing 40. The driving unit includes a non-illustrative wire fixed to the scanning optical unit 41, a plurality of driven pulley (not illustrated) and driving pulleys (not illustrated) linked to the wire, and a motor which rotates the driving pulleys.

The sheet feeding unit 3 includes a sheet feeding cassette 30 and a sheet feeding unit 31. The sheet feeding cassette 30 has sheets of paper (not illustrated) as recording mediums in different sizes. The sheet feeding unit 31 carries the sheets of paper contained in the sheet feeding cassette 30 to a main carriage path 70 of the apparatus body unit 5.

On the side surface of the apparatus body unit 5, a manual feed tray 32 is openably/closably provided. A bunch of sheets are manually fed onto the upper surface of the tray, in a state where it is open to the apparatus body unit 5. The top of the manually fed sheets is sent toward the main carriage path 70 by a sending roller of the manual feed tray 32.

A pair of resistor rollers 70*a* are provided on the main carriage path 70. After the pair of resistor rollers 70*a* hold the sheet of paper carried in the main carriage path 70 in between, they send the sheet of paper toward a secondary transfer nip at a predetermined timing.

The apparatus body unit 5 has an exposure unit 51, a tandem image forming apparatus 50, an intermediate transfer belt 54, an intermediate transfer roller 55, a secondary transfer apparatus 52, and a fixing unit 53. It also has the main carriage path 70, a reversing carriage path 73, and a sheet discharge path 60.

As illustrated in FIG. 1, the exposure unit 51 is arranged adjacent to the tandem image forming apparatus 50. The exposure unit 51 performs exposure to photosensitive drums 74 corresponding to respective colors.

The tandem image forming apparatus 50 is above the intermediate transfer belt 54, and includes four image forming units 75 of yellow, cyan, magenta, and black, along the rotation direction of the intermediate transfer belt 54. Though not specifically illustrated, each of the image forming units 75 includes a charging apparatus, a developing apparatus, a photosensitive cleaning apparatus, and a neutralizing apparatus, around the photosensitive drum 74 of the corresponding color. Each photosensitive drum 74 and the above-described apparatuses provided around the photosensitive drum 74 are unitized to form one process cartridge.

The tandem image forming apparatus 50 is to form a visible image (a toner image) formed with toners of colors corresponding to the respective photosensitive drums 74, based on image information read and color-separated by the image reading unit 4. The visible image formed through the respective photosensitive drums 74 are transferred to the intermediate transfer belt 54, between the photosensitive drums 74 and the intermediate transfer roller 55.

On the opposite side of the tandem image forming apparatus 50 across the intermediate transfer belt 54, the secondary transfer apparatus 52 is provided. The secondary transfer apparatus 52 has a secondary transfer roller 521 as a transfer member. This secondary transfer roller 521 is pressed onto the intermediate transfer belt 54, to form the secondary transfer nip. The secondary transfer nip is formed that the toner image formed on the intermediate transfer belt 54 is transferred onto the sheet of paper carried from the sheet feeding unit 3 through the main carriage path 70.

The sheet of paper with the toner image transferred by the secondary transfer nip is sent to the fixing unit 53 by a sheet carriage belt 56 stretched by two supporting rollers 57.

The fixing unit 53 is formed with a pressure roller 59 pressing onto a fixing belt 58 as an endless belt. The fixing unit 53 applies heat and pressure to the sheet of paper, using the pressure roller 59. As a result, the toners of the toner image transferred to the sheet of paper melt and are fixed in the form of a color image on the sheet of paper.

Accordingly, the sheet of paper with the fixed color image is stacked on a sheet discharge tray 61 outside the apparatus through the sheet discharge path 60 as a sheet discharge carriage path.

As illustrated in FIG. 1, the reversing carriage path 73 is provided below the secondary transfer apparatus 52 and the fixing unit 53. The reversing carriage path 73 turns over the front side and the back side of the sheet of paper discharged from the fixing unit 53, to form images on both surfaces of the sheet of paper, and discharges again the sheet of paper to the secondary transfer apparatus 52 through the main carriage path 70.

On the main carriage path 70 and the reversing carriage path 73, sheet detection sensors are arranged, as a plurality of detection units for detecting the paper jam along the carriage path. The number and arrangement positions of the sheet detection sensors are appropriately set. When each of the sheet detection sensors does not detect passage of the sheet of paper for a predetermined period of time, it is aware of occurrence of paper jam, and informs a non-illustrative display unit of the image forming apparatus 1 about the jam occurrence.

The image forming apparatus 1 of this embodiment has the secondary transfer apparatus 52, the fixing unit 53, the main carriage path 70, the sheet discharge path 60, and the reversing carriage path 73, illustrated in FIG. 1. The apparatus 1 also includes a drawer unit 76 which is movable to/from the apparatus body unit 5.

Figure 2:
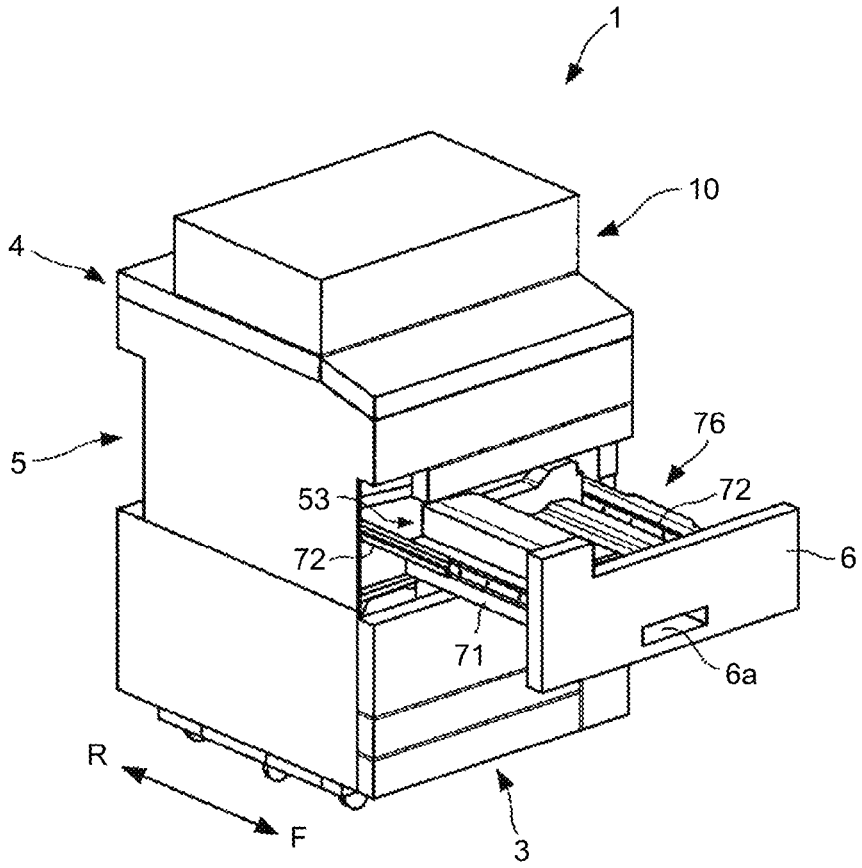
FIG. 2 is a perspective diagram of an image forming apparatus.

FIG. 2 is a perspective diagram of the image forming apparatus 1.

The drawer unit 76 has a carrier 71 holding the secondary transfer apparatus 52, the fixing unit 53, the main carriage path 70, and the reversing carriage path 73. The carrier 71 includes a front cover 6 as a drawer unit cover part which covers the front side of the drawer unit 76 of the outer cover. The carrier 71 is supported movably along the front-back direction (an arrow FR in FIG. 2) of the apparatus body unit 5 through a rail 72 provided in the apparatus body. A handle unit 6*a* in the front cover 6 is held by a user, and the front cover 6 is moved along the front-back direction (arrow FR in FIG. 2) toward/from the apparatus body unit 5. As a result, the drawer unit 76 can be drawn out from the apparatus body unit 5. In this specification, the front side F of the image forming apparatus 1 implies the front side of the image forming apparatus 1, while the rear side R implies the back side of the image forming apparatus 1.

Figure 3:
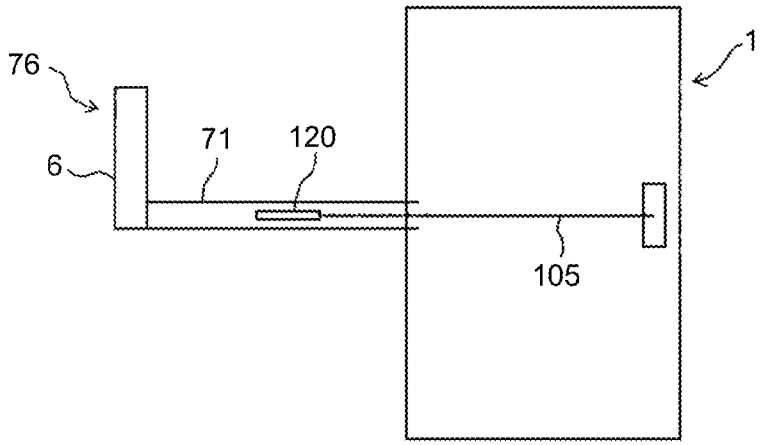
FIG. 3 is a schematic view of when a drawer unit is drawn out.

FIG. 3 is a schematic view of when the drawer unit 76 is drawn out. In FIG. 3, no illustration is made of the secondary transfer apparatus 52, the fixing unit 53, the main carriage path 70, and the reversing carriage path 73, held by the carrier 71. Also in the drawer unit 76 to be illustrated below, no illustration is made of the secondary transfer apparatus 52, the fixing unit 53, the main carriage path 70, and the reversing carriage path 73, held by the carrier 71, appropriately.

As illustrated in FIG. 3, an electrical substrate 120 is arranged in the drawer unit 76. The electrical substrate 120 has a CPU and a ROM. The ROM stores control programs for controlling the secondary transfer apparatus 52, controlling the fixing unit 53, controlling carriage of the sheet of paper on the main carriage path 70, controlling carriage of the sheet of paper on the reversing carriage path 73, and controlling jam detection. In this embodiment, as illustrated in FIG. 3, even in a state where the drawer unit 76 is drawn out, the electrical substrate 120 and the apparatus body are connected using a binding wire 105 as an electrical wire, for sustaining electric connection. In this manner, by arranging the electrical substrate 120 for controlling the apparatuses held by the carrier 71 in the drawer unit 76, the binding wire necessary for the connection includes only one binding wire 105 connecting the electrical substrate 120 and the apparatus body, thus easily ensuring the binding wire path.

Figure 4:
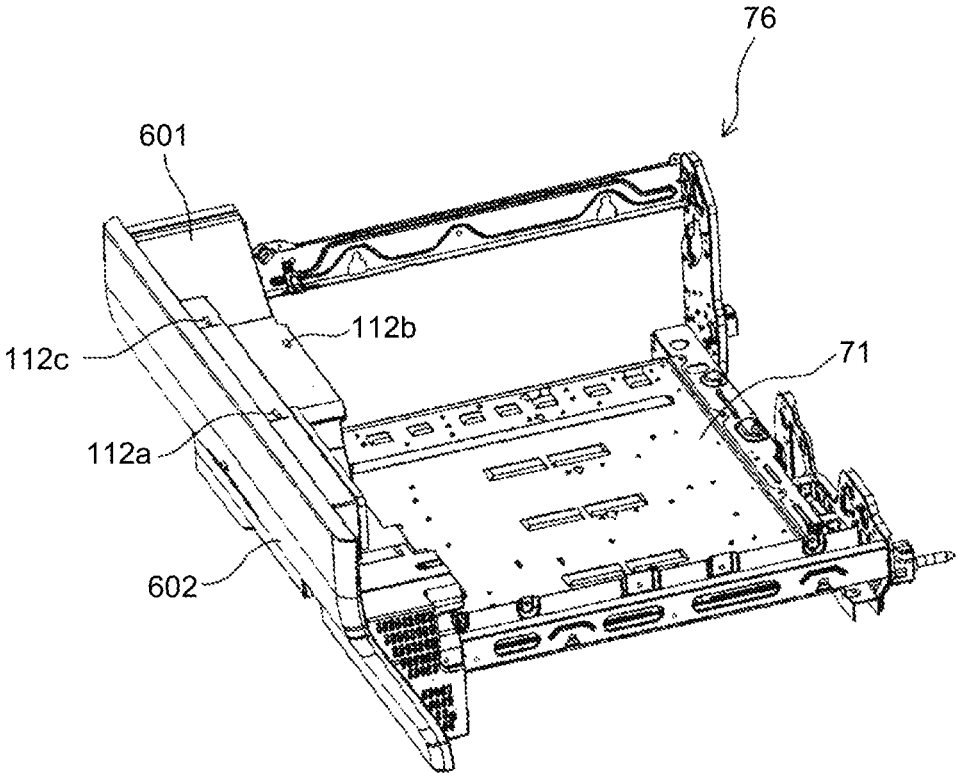
FIG. 4 is a perspective diagram of the drawer unit.

FIG. 4 is a perspective diagram of the drawer unit 76.

As illustrated in FIG. 4, the front cover 6 includes an outer cover unit 602 exposed from the apparatus even when the drawer unit 76 is closed to the apparatus body and also an inner cover unit 601 exposed therefrom when the drawer unit 76 is drawn out from the apparatus body unit 5. On the upper surface of this inner cover unit 601, a plurality of drawer units LED 112*a* to 112*c* are provided as notification units for notifying an occurrence position of paper jam.

Upon detection of jam at the secondary transfer apparatus 52, the fixing unit 53, the main carriage path 70, the sheet discharge path 60, and the reversing carriage path 73, held by the drawer unit 76, any of the drawer unit LEDs 112*a* to 112*c* corresponding to the position of the jam emits light. In this embodiment, as illustrated in FIG. 4, also when the drawer unit 76 is drawn out from the apparatus body, electric connection is made by the binding wire 105. Thus, when the user draws out the drawer unit 76 for performing a jam process, it is possible to turn on any of the drawer unit LEDs 112*a* to 112*c* corresponding to the position of the jam. The drawer unit LEDs 112*a* to 112*c* are arranged in positions corresponding to the positions of the jam occurrence. For example, the first drawer unit LED 112*a* is provided in a position corresponding to a non-illustrative operation member which is operated at removal of a sheet of paper jammed along the carriage path from the sheet feeding unit 3 to the secondary transfer nip of the drawer unit 76. The second drawer unit LED 112*b* is provided in a position corresponding to a non-illustrative operation member which is operated at removal of a sheet of paper jammed along the carriage path from the secondary transfer nip to the fixing unit 53. The third drawer unit LED 112*c* is provided in a position corresponding to a non-illustrative operation member which is operated at removal of a sheet of paper jammed along the sheet discharge path 60 from the fixing unit 53 to the sheet discharge tray 61. Though not illustrated, a drawer unit LED is provided in a position corresponding to a non-illustrative operation member provided on the front surface of the outer cover unit 602 which is operated at removal of the sheet of paper jammed in the reversing carriage path 73.

Figure 5:
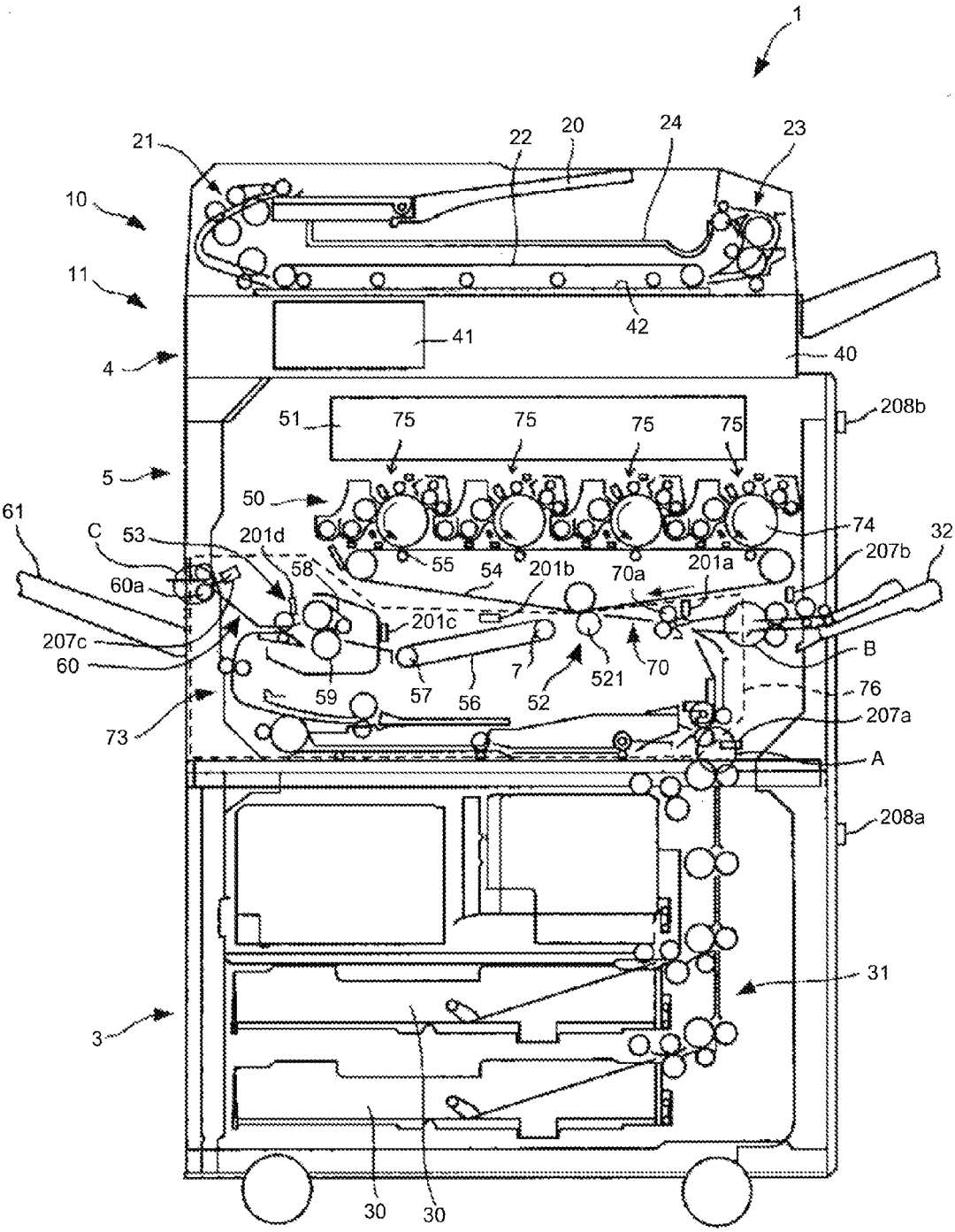
FIG. 5 is a diagram illustrating an example of an arrangement position of a sheet detecting sensor.

FIG. 5 is a diagram illustrating an example of an arrangement position of a sheet detection sensor as a paper jam detection unit. As illustrated in FIG. 5, the apparatus has a pre-secondary transfer sheet detection sensor 201*a* and a post-secondary transfer sheet detection sensor 201*b*. The sensor 201*a* detects sheets of paper passing through the pair of resist rollers 70*a*, while the sensor 201*b* detects sheets of paper passing through the sheet carriage belt 56. The apparatus also has a pre-fixing sheet detection sensor 201*c* and a post-fixing sheet detection sensor 201*d*. The sensor 201*c* is arranged in front of the fixing unit 53 and detects sheets of paper carried to the fixing unit 53, while the sensor 201*d* is arranged behind the fixing unit 53 and detects sheets of paper passing through the fixing unit 53.

For example, at the time of jam occurrence, when the pre-secondary transfer sheet detection sensor 201*a* detects a sheet of paper, the first drawer unit LED 112*a* is turned on. At the time of jam occurrence, when the post-secondary transfer sheet detection sensor 201*b* or the pre-fixing sheet detection sensor 201*c* detects a sheet of paper, the second drawer unit LED 112*b* is turned on. At the time of jam occurrence, when the post-fixing sheet detection sensor 201*d* detects a sheet of paper, the third drawer unit LED 112*c* is turned on.

Then, to perform a jam process, from the lighted drawer unit LED, the user can easily understand which operation member to operate, thus enabling to perform an appropriate jam process. After the user removes the jammed sheet of paper, the sheet detection sensor no more detects the sheet of paper, a corresponding drawer unit LED is turned off. If the user visibly checks that the entire drawer unit LEDs are turned off, the drawer unit 76 is returned back to the apparatus body, and the jam process ends. As a result, this prevents the user from forgetting to perform the jam process.

It is preferred that the drawer unit 76 can be drawn out for a length longer than the drawing length of the drawer unit of the apparatus body. According to this configuration, it is possible to draw out the secondary transfer apparatus 52, the fixing unit 53, the main carriage path 70, the sheet discharge path 60, and the reversing carriage path 73 held by the drawer unit 76, entirely from the apparatus body. This enables to easily perform the jam process.

It is desired that the drawer unit LEDs 112*a* to 112*c* as notification units be arranged in positions that can easily be seen from the front side in a state where the drawer unit 76 is open. In this embodiment, they are provided on the upper surface of the inner cover unit 601 of the front cover 6 which can be considered to be easily seen when the drawer unit 76 is drawn out from the apparatus body.

When the jam occurs and the carriage of the sheet of paper stops, the sheet may stop and lie across the carriage path of the drawer unit 76 and the carriage path except the drawer unit. In this embodiment, as illustrated in FIG. 5, there exists a sheet feeding path across part A across which the sheet lies when it is carried from the sheet feeding unit 3 to the drawer unit. There exists also a manual path across part B across which the sheet lies when it is carried from the manual feed tray 32 to the drawer unit. Further, there exists a discharge path across part C across which the sheet lies when it is discharged from the drawer unit 76 to the sheet discharge tray 61.

Figure 6:
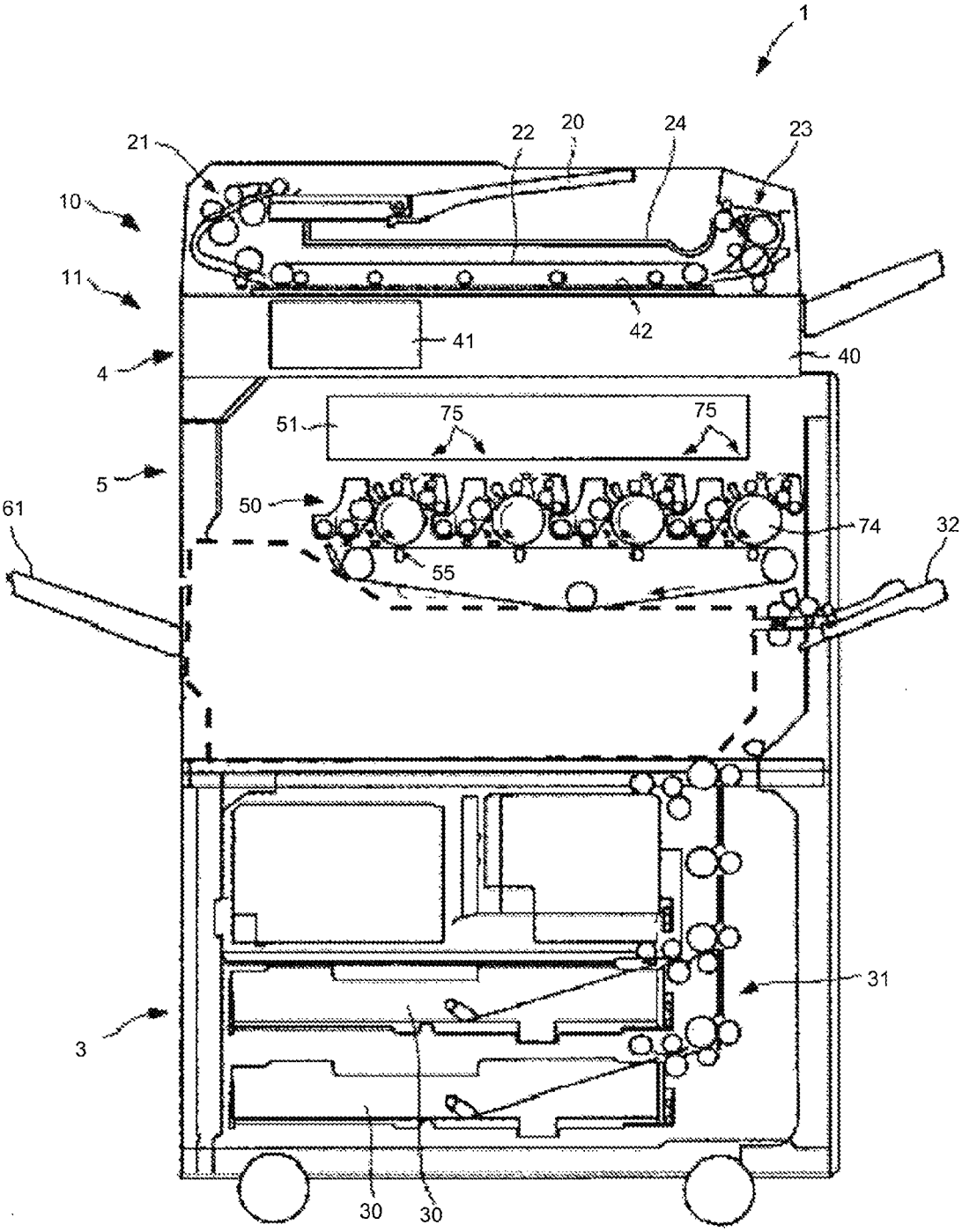
FIG. 6 is a schematic block diagram of an image forming apparatus in a state where the drawer unit is drawn out.

FIG. 6 is a schematic block diagram of the image forming apparatus 1 when the drawer unit 76 is drawn out therefrom. As illustrated in FIG. 6, when the drawer unit 76 is drawn out, the sheet feeding unit 3, the manual feed tray 32, and the sheet discharge tray 61 are positioned on the side of the apparatus body.

At the jam process, when the drawer unit 76 is drawn out in a state where the sheet of paper lies across at any of the above across parts, a part of the sheet positioned on the side of the drawer unit comes up to the apparatus body unit, while the sheet of paper is crumpled. A part of the sheet positioned on the side of the apparatus body unit 5 or the sheet feeding unit 3 comes up to the drawing direction of the drawer unit 76, while the sheet of paper is crumpled. Then, if the drawer unit 76 is drawn out entirely from the apparatus body, the sheet of paper is torn off, that is, the sheet of paper is separated in pieces. The sheet of paper, which has come up to the apparatus body unit of the drawer unit 76 drawn out from the apparatus body unit 5 and has been torn off, enters complicatedly into spaces of the apparatus body of the drawer unit 76. This results in a difficulty of removal of the sheet. Similarly, a sheet of paper, which has come up to the drawing direction of the apparatus body or sheet feed unit and has been torn off, also enters complicatedly into spaces in the drawing direction of the apparatus body or sheet feeding unit, thus resulting in a difficulty of removal of the sheet of paper. In this manner, if the user tries to forcibly remove the sheet of paper which has complicatedly entered into the spaces and crumpled after coming up to one direction of the drawer unit 76, the apparatus body unit 5, or the sheet feeding unit 3, the sheet of paper is torn off, and pieces of paper may remain in the drawer unit 76 or the apparatus body unit 5 (sheet feeding unit 3). As a result, the pieces of paper get stuck in the carriage roller provided in the drawer unit 76 or the carriage roller provided in the apparatus body unit or the sheet feeding unit, thus undesirably resulting in a carriage failure. If pieces of the paper remain in the sheet detection sensor provided in the drawer unit 76, jam detection may not desirably be performed.

In this embodiment, at the time of jam process, when the sheet of paper lies across at any of the above-described across parts, the drawer unit 76 is set not to be drawn out from the apparatus body. Only if the across sheet of paper is removed, the drawer unit 76 can now be drawn out from the apparatus body.

As illustrated in FIG. 5, in this embodiment, a sheet feeding carriage sensor 207*a* is provided as an across detection unit which detects the sheet of paper lying across at the sheet feeding path across part A, in the vicinity of the sheet feeding path across part A. A manual sheet feeding sensor 207*b* is provided as an across detection unit which detects the sheet of paper lying across at the manual path across part B, in the vicinity of the manual path across part B. A sheet discharge sensor 207*c* is provided as an across detection unit which detects the sheet of paper lying across at the sheet discharge path across unit C, in the vicinity of the sheet discharge path across unit C. The sheet feeding carriage sensor 207*a* and the manual sheet feeding sensor 207*b* are provided in the apparatus body unit 5, while the sheet discharge sensor 207*c* is provided in the drawer unit 76. The above-described sheet feeding carriage sensor 207*a*, the manual sheet feeding sensor 207*b*, and the sheet discharge sensor 207*c* detecting the lying across sheet are generally called as across sensors 207, unless otherwise distinguished. When any of these across sensors 207 detects a jam, the drawer unit 76 is locked in the apparatus body using a lock mechanism, as will be described later.

As illustrated in FIG. 5, an upper right cover LED 208*b*, as a notification unit, is provided on the right cover member of the apparatus body unit. A lower right cover LED 208*a* is provided on the right cover member of the sheet feeding unit 3. These cover LEDs 208*a* and 208*b* are prepared to notify the user which part is to be operated, when a jam process is performed.

Figure 7A:
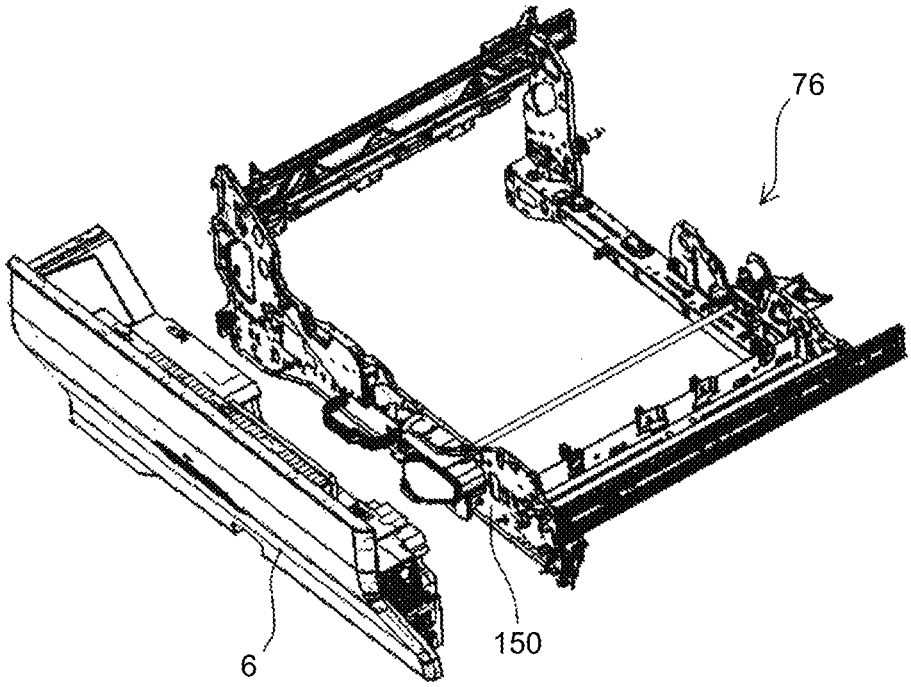
FIG. 7A is an exploded perspective view of a carrier and a front cover of the drawer unit.
Figure 7B:
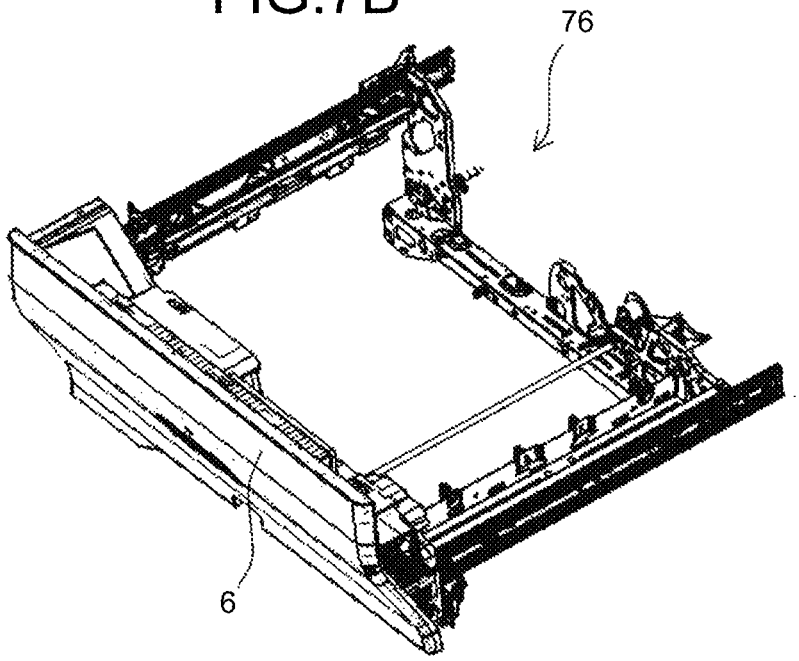
FIG. 7B is a perspective diagram of the front cover fixed to the carrier of the drawer unit.

FIG. 7A is an exploded perspective view of the carrier 71 and the front cover 6 of the drawer unit 76, and FIG. 7B is a perspective diagram of the front cover 6 fixed to the carrier 71 of the drawer unit 76.

Figure 8:
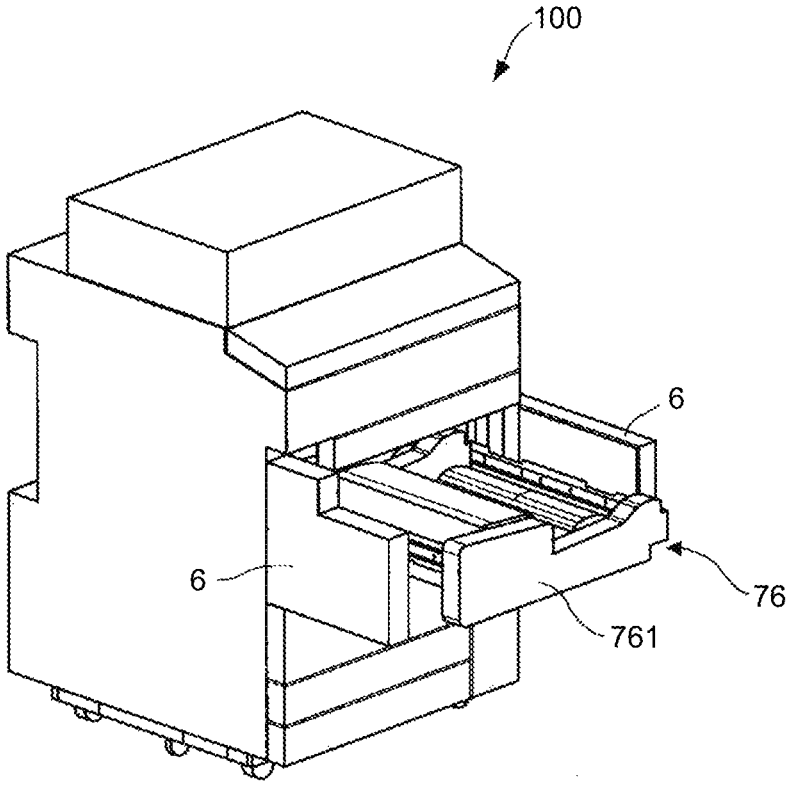
FIG. 8 is a perspective diagram of the image forming apparatus in which the front cover is formed separately from the drawer unit.

The front cover 6 is screwed to a drawer unit front plate 150, and does not come off without using a tool. In this embodiment, the front cover 6 is fixed to the drawer unit 76. As a result, the drawer unit 76 can be drawn out simply by drawing out the front cover 6. This enables that an operation for drawing out the drawer unit 76 is achieved by one action, and thus enhancing the work efficiency of the jam process, as compared to a configuration in which the front cover 6 is open/closed to draw out the drawer unit 76, as illustrated in FIG. 8.

Figure 9:
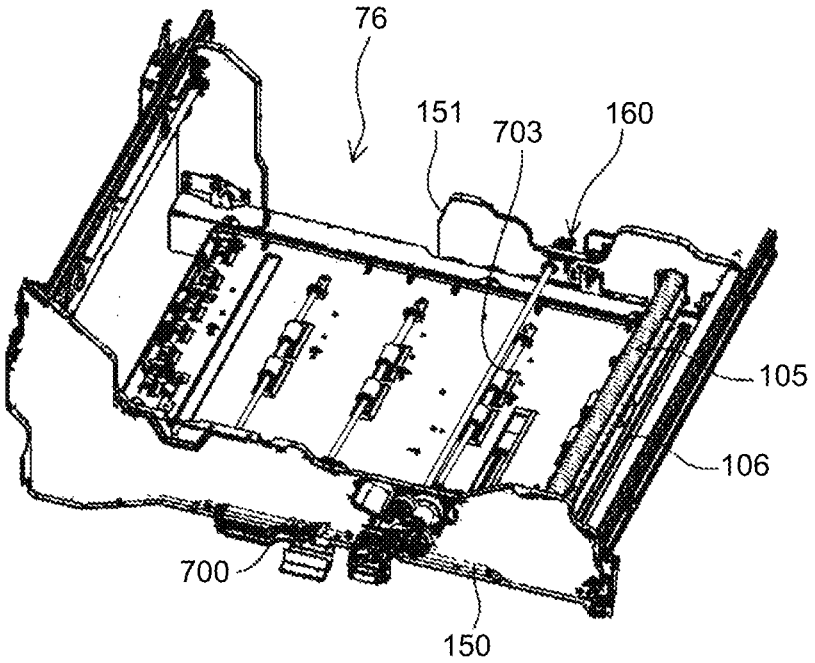
FIG. 9 is a perspective diagram of the drawer unit from which the front cover has been removed.

FIG. 9 is a perspective diagram of the drawer unit 76 from which the front cover 6 has been removed.

FIG. 9 illustrates a state in which the drawer unit is included in the apparatus body unit.

As illustrated in FIG. 9, the binding wire 105 is arranged on the right end part of the illustration (end part of the main carriage path 70), in the drawer unit 76, and the binding wire 105 is held by a code guide 130. The binding wire 105 is so-called a curled code which is helically curled. Because a curled code is used as the binding wire 105, the binding wire 105 can be extensible in the drawing direction. As compared to a case where the biding wire 105 is not extensible, it is possible to restrain deflection of the binding wire 105. Thus, when seen from the drawing direction of the drawer unit 76, it is possible to prevent deflection of the binding wire 105 sticking out from the drawer unit 76 and also to prevent that the binding wire 105 gets caught in the parts of the apparatus body. The code guide 130 is attached to a body rear plate 501, as will be described later, (see FIG. 15) of the apparatus body unit 5. As illustrated in FIG. 9, in a state where the drawer unit is included in the apparatus body unit 5, the code guide 130 is included in the drawer unit 76. Once the drawer unit 76 is drawn out from the apparatus body, the code guide 130 is drawn out from a drawer unit rear plate 151 together with the binding wire 105 relatively from the drawer unit 76. As a result, the binding wire 105 drawn out relatively from the drawer unit 76 is guided by the code guide 130, thus preventing deflection thereof (see FIG. 15).

A lock shaft 703 is rotationally supported by the drawer unit front plate 150 and the rear plate 151. A lock mechanism 160 is provided on the rear end part of the lock shaft 703.

Figure 10:
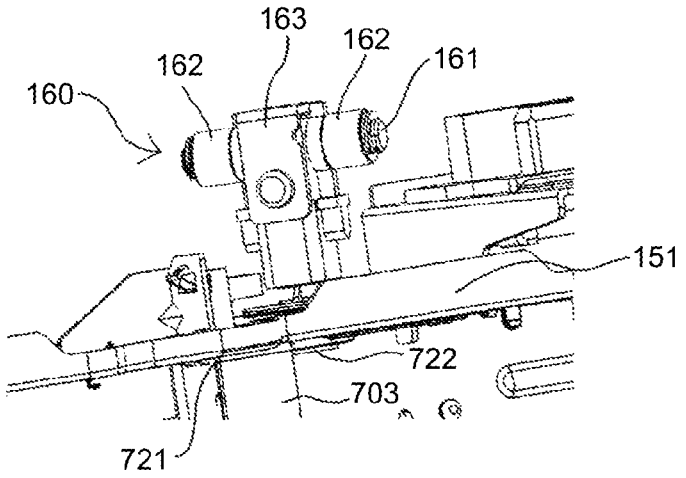
FIG. 10 is a perspective diagram illustrating a configuration of a lock mechanism.

FIG. 10 is a perspective diagram illustrating a configuration of the lock mechanism 160.

As illustrated in FIG. 10, the rear end part of the lock shaft 703 protrudes from the drawer unit rear plate 151, and the lock mechanism 160 is attached to the end part thereof. The lock mechanism 160 has a fitting member 163 with a prism form, fixed to the lock shaft 703. The lock mechanism 160 has a roller shaft 161 which is fixed to the fitting member 163, to penetrate into a direction orthogonal to the axial direction of the lock shaft 703. Rotational rollers 162 are attached rotationally with respect to the roller shaft 161, at both end parts of this roller shaft 161.

As illustrated in FIG. 10, the lock shaft 703 is attached to the drawer unit rear plate 151 through a sintering bearing 721. An E ring 722 is fixed to a groove formed in the lock shaft 703, to come into contact with the front side surface of the drawer unit rear plate 151.

As illustrated in FIG. 9, the drawer unit front plate 150 has a driving unit 700 for rotationally driving the lock mechanism 160 through the lock shaft 703.

Figure 11:
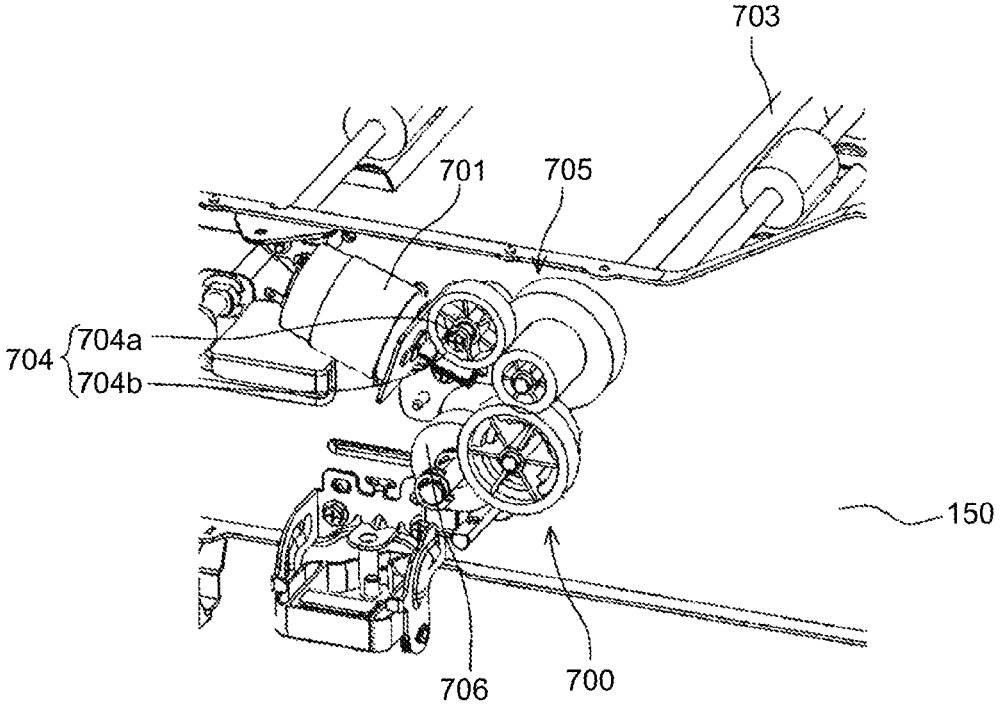
FIG. 11 is a perspective diagram illustrating a configuration of a driving unit.

FIG. 11 is a perspective diagram illustrating a configuration of the driving unit 700.

As illustrated in FIG. 11, the driving unit 700 includes a driving motor 701. The driving motor 701 is fixed to the drawer unit front plate 150 in a manner that the motor axis becomes parallel to the drawer unit front plate 150. If the driving motor 701 is thus fixed, the drawer unit 76 is prevented from being enlarged in the drawing direction, as compared to the case where the motor axis of the driving motor 701 is fixed to be orthogonal to the drawer unit front plate 150.

A crossed helical gear 704*a* of a worm gear 704 is fixed to the motor axis of the driving motor 701. A driving force of the driving motor 701 is transmitted to a driven gear 706 fixed to the lock shaft 703, from a helical gear 704*b* of the worm gear 704 engaged with the helical gear 704*a*, through a gear train 705 including a plurality of idler gears. Upon transmission of this force, the lock shaft 703 is rotationally driven.

Figure 12:
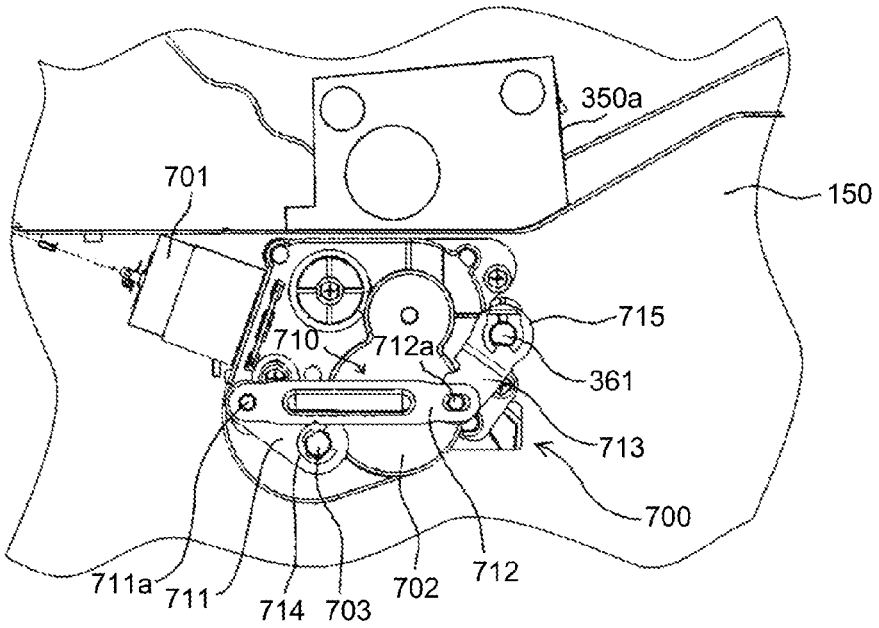
FIG. 12 is a front view of the driving unit.

FIG. 12 is a front view of the driving unit 700.

As illustrated in FIG. 12, the worm gear 704, the plurality of idler gears included in the gear train 705, and the driven gear 706 fixed to the lock shaft 703 are contained in a case 702.

To the front end part of the lock shaft 703, a link mechanism 710 is connected. This mechanism transmits the driving force to an attachment/detachment mechanism for attaching/ detaching the secondary transfer roller 521 (described later) to/from the intermediate transfer belt 54.

The link mechanism 710 includes an output link member 711, a connection link member 712, and an input link member 713. One end of the output link member 711 is fixed to the lock shaft 703, and the other end thereof has an output protruding part 711*a*. The front end part of the lock shaft 703 has a D-like form in cross section, and an end of the output link member 711 has a fitting hole with a D-like form, to fit into the front end part of the lock shaft 703. To avoid coming off of the output link member 711 from the lock shaft 703, an E ring 714 is attached to the lock shaft 703. As a result, the output link member 711 is fixed to the lock shaft 703.

An end of the connection link member 712 is rotationally attached to the output protruding part 711*a* of the output link member 711. A long hole 712*a* is formed on the other end of the connection link member 712, and an input protruding part 713*a* provided in one end of the input link member 713 is fit into this long hole 712*a*. The end part of an input shaft 361, for inputting a driving force to the attachment/detachment mechanism (as will be described later), has a D-like form in cross section, and a fitting hole formed in the other end of the input link member 713 and having a D-like form is fit to an end of the input shaft 361. The E ring 714 is attached to the input shaft 361, thus avoiding coming off of the input link member 713 from the input shaft 361.

The link mechanism 710 is used for transmitting the driving force from the lock shaft 703 to the input shaft 361. With this mechanism, a plate member can be used as each link member, and the drawer unit 76 can be prevented from being enlarged in a drawing direction, as compared to a case where the driving force is transmitted by the gear.

Descriptions will now be made to the attachment/detachment mechanisms for attaching/detaching the secondary transfer roller 521 to/from the intermediate transfer belt 54. The attachment/detachment mechanisms are provided on both ends (front side/rear side) in the axial direction of the secondary transfer roller, and have the same configuration.

Figure 13:
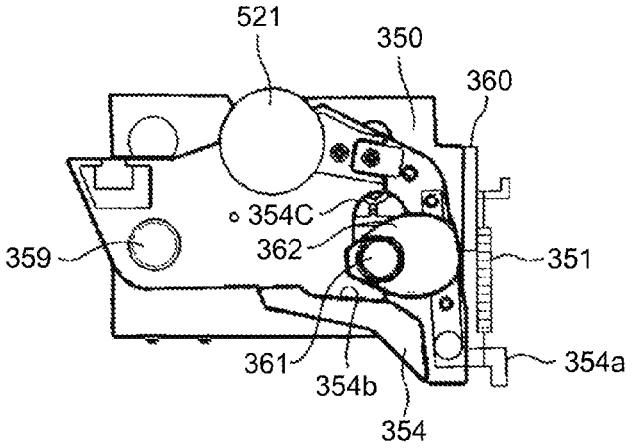
FIG. 13 is a schematic block diagram of a secondary transfer roller attachment/detachment mechanism.

FIG. 13 is a schematic block diagram of the attachment/detachment mechanism provided on one end side in the axial direction of the secondary transfer roller 521.

The secondary transfer roller 521 is rotationally supported by a holding member 354. The holding member 354 is rotationally supported by a supporting shaft 359 formed in a frame 350 of the secondary transfer apparatus. A spring bracket 354*a* is provided on an opposite side end across the supporting shaft 359 of the holding member 354 and the secondary transfer roller 521. An end of a spring 351 is attached to the spring bracket 354*a*, and the holding member 354 is pressed forcibly upward in the illustration (the side of the intermediate transfer belt 54) by this spring 351. A long hole 354*c* is provided on the opposite side across the supporting shaft 359 of the holding member 354 and the secondary transfer roller 521. The above-described input shaft 361 penetrates through this long hole 354*c*. A release cam 362 is formed on this input shaft 361. A butted part 354*b* against which the release cam 362 butts is provided in the holding member 354.

Figure 14:
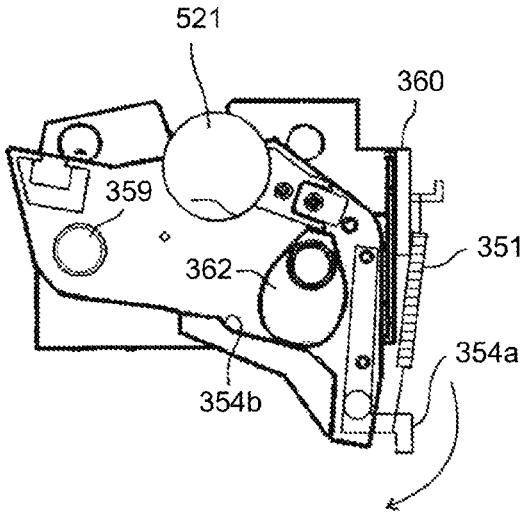
FIG. 14 is a diagram illustrating a state where the secondary transfer roller is positioned in a separated position.

As illustrated in FIG. 13, in a state where the release cam 362 is separated from the butting part 354*b*, the secondary transfer roller 521 comes into contact with the intermediate transfer belt 54 at a predetermined pressure by a pressing force of the spring 351. When the drawer unit 76 is drawn out, the input shaft 361 is rotationally moved, and the release cam 362 is rotationally moved in a clockwise direction of the illustration. Then, the release cam 362 is butted against the butting part 354*b*. Further, if the input shaft 361 is rotationally moved, the holding member 354 is rotationally moved by the release cam 362 in a clockwise direction in the illustration, with the supporting shaft 359 as a fulcrum against the pressing force of the spring 351, as illustrated in FIG. 14. As a result, the secondary transfer roller 521 is separated from the intermediate transfer belt 54. That is, in this embodiment, the attachment/detachment mechanism is configured to attach/detach the secondary transfer roller 521 to/from the intermediate transfer belt 54, with using the holding member 354, the spring 351, and the release cam 362.

In this embodiment, the secondary transfer roller 521 is configured to move approximately 5 to 7 mm, from a pressure position illustrated in FIG. 13 to a retraction position illustrated in FIG. 14.

Figure 15:
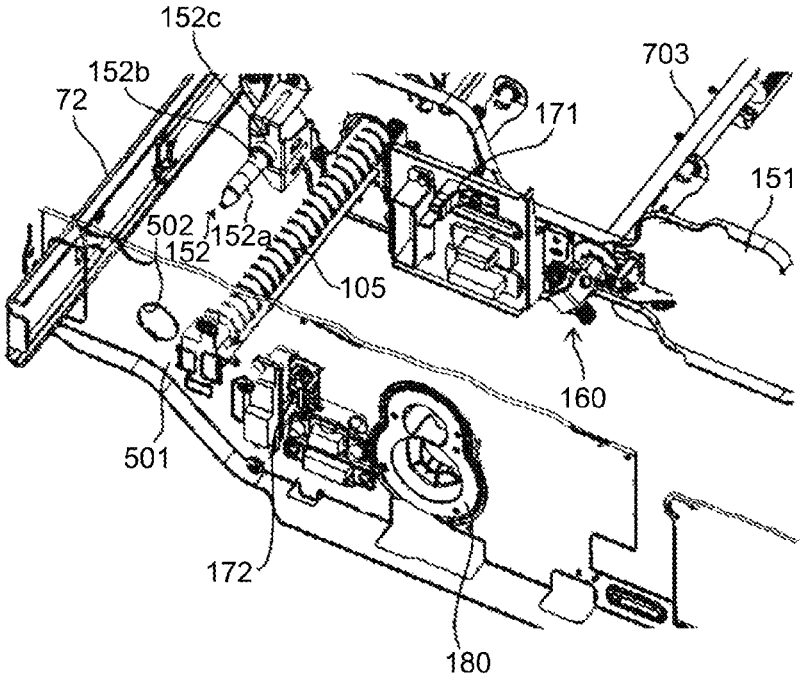
FIG. 15 is a perspective diagram of the rear side of the apparatus body in a state where the drawer unit is drawn out.
Figure 16:
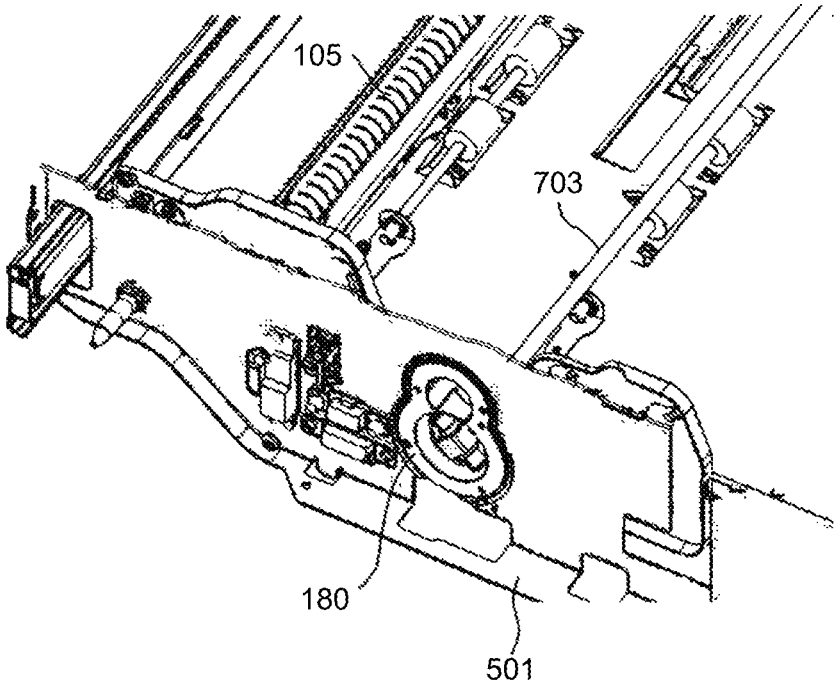
FIG. 16 is a perspective diagram of the rear side of the apparatus body in a state where the drawer unit is set to the apparatus body.

FIG. 15 is a perspective diagram of the rear side of the apparatus body in a state where the drawer unit 76 is drawn out, and FIG. 16 is a perspective diagram of the rear side of the apparatus body in a state where the drawer unit 76 is set to the apparatus body unit 5.

A positioning hole 502 is provided in the vicinity of the body rear plate 501 of the apparatus body unit 5, in the left end part of the illustration. Into this positioning hole 502, a positioning pin 152 is inserted. This pin 152 is provided on the left end part of the drawer unit 76 in the illustration. The positioning pin 152 includes a fitting unit 152*b* and a guiding unit 152*a*. The fitting unit 152*b* is fit into the positioning hole 502, while the guiding unit 152*a* with a taper shape guides the fitting unit 152*b* to the positioning hole. When the drawer unit is locked in the apparatus body unit 5 by the lock mechanism 160 (described later), it has a bearing surface part 152*c* with a larger diameter than that of the fitting unit 152*b* pressed against the body rear plate 501.

A set detection sensor 172 is formed in the body rear plate 501, and detects that the drawer unit 76 is set to the apparatus body unit 5. A filler 171 is formed in the drawer unit rear plate 151, as a detection target unit (whether set or not) detected by the set detection sensor 172. That is, in this embodiment, a set detection mechanism, as a set detection unit, is configured to detect setting of the apparatus body unit 5 of the drawer unit 76, with using the set detection sensor 172 and the filler 171.

Figure 17:
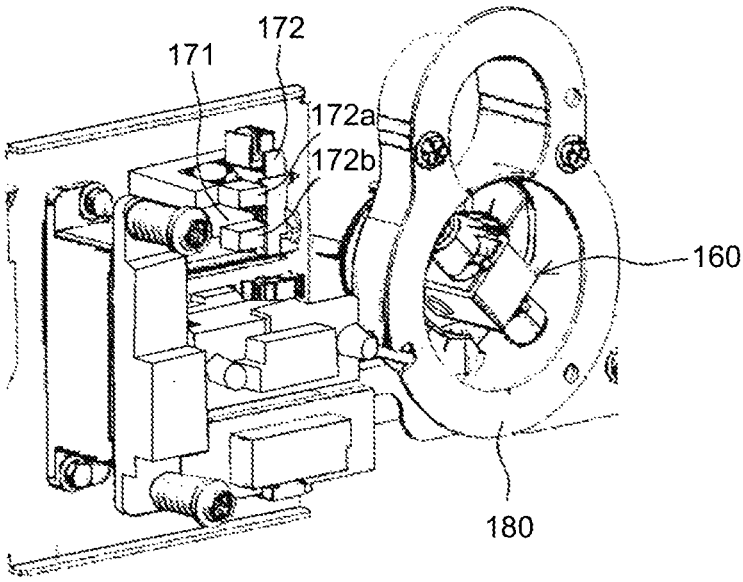
FIG. 17 is an enlarged block diagram illustrating the vicinity of a set detection sensor.

FIG. 17 is an enlarged block diagram of the vicinity of the set detection sensor 172.

As illustrated in FIG. 17, as the set detection sensor 172, a photo-interrupter (transmission optical sensor) is used. When the drawer unit 76 is set to the apparatus body unit 5, the filler 171 for set detection provided in the drawer unit rear plate 151 enters between a light receiving unit 172*b* and a light emitting unit 172*a* of the set detection sensor 172, and blocks off the light of the light emitting unit 172*a*. As a result, the light receiving unit 172*b* does not detect light from the light emitting unit 172*a*, and the sensor can detect that the drawer unit 76 has been set to the apparatus body unit 5.

As illustrated in FIG. 15 and FIG. 16, there is provided a lock receiving member 180 against which the rotational rollers 162 of the above-described lock mechanism 160 are pressed when the drawer unit 76 is locked in the apparatus body unit 5.

Figure 18:
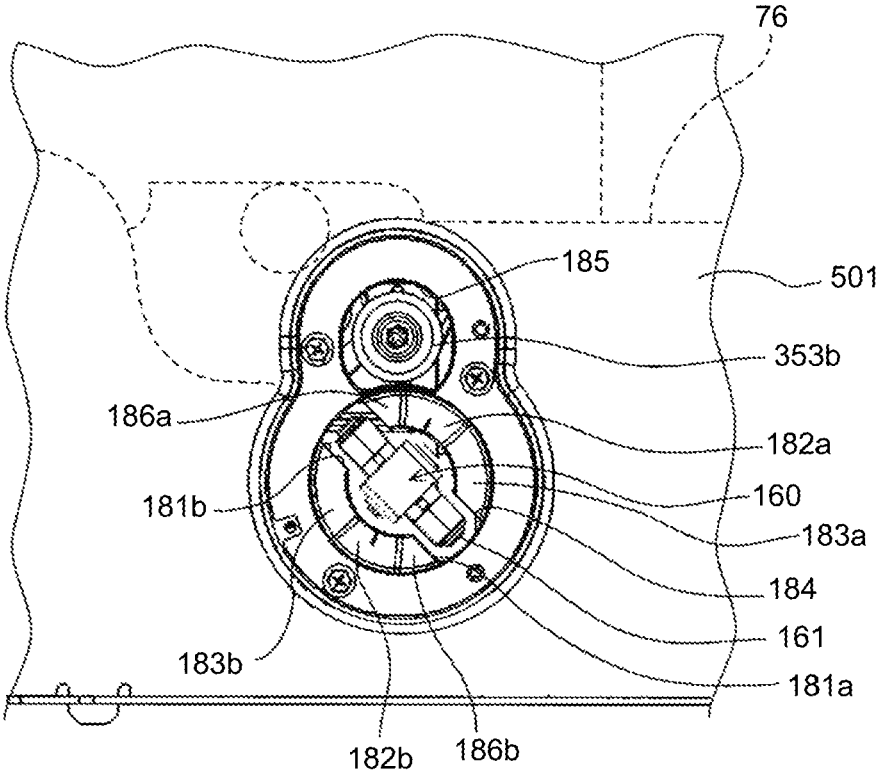
FIG. 18 is an enlarged block diagram illustrating the vicinity of a lock reception member.
Figure 19:
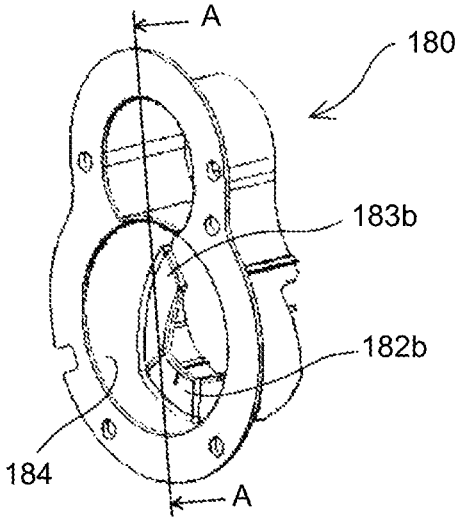
FIG. 19 is a perspective diagram of the lock reception member.

FIG. 18 is an enlarged block diagram of the vicinity of the lock receiving member 180, and FIG. 19 is a perspective diagram of the lock receiving member 180.

The lock receiving member 180 includes a locking through hole 184, into which the lock mechanism 160 is inserted. On the upper part of the locking through hole 184, a secondary transfer through hole 185 is provided. Into the hole 185, a joint member 353*b* fixed to the shaft of the secondary transfer roller 521 is inserted. As illustrated in FIG. 19, the secondary transfer through hole 185 and the lock through hole 184 of the lock receiving member 180 have a cylindrical shape.

Figure 20:
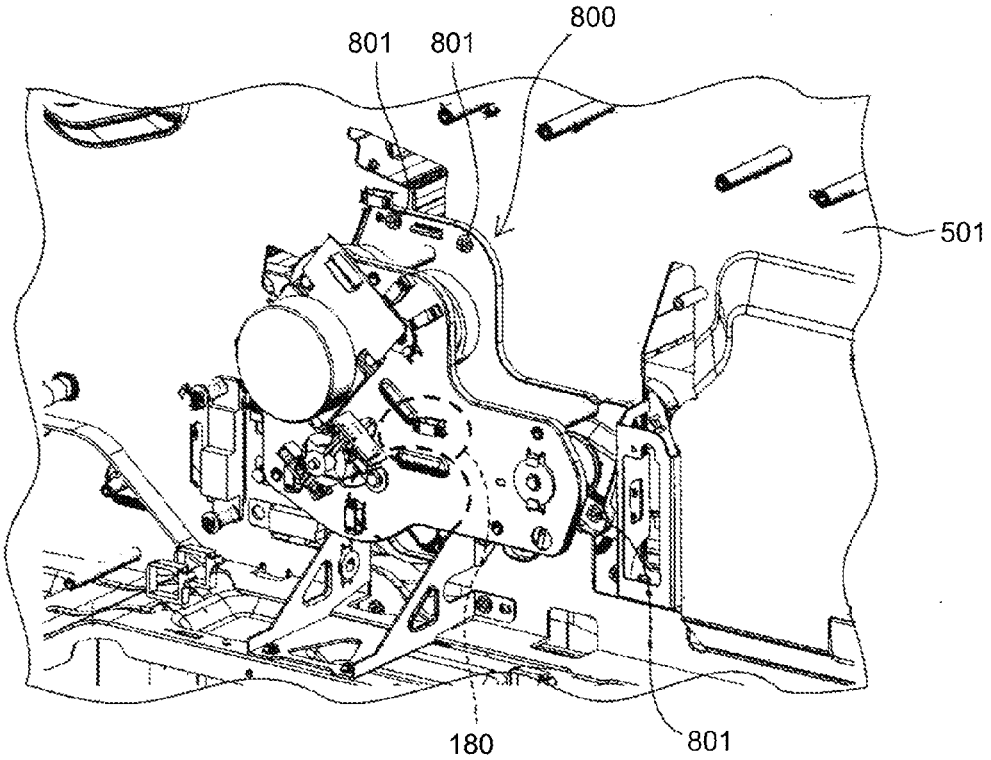
FIG. 20 is a diagram for explaining an arrangement position of a secondary transfer driving unit.

When the drawer unit 76 is set to the apparatus body unit 5, the above-described joint member 353*b* penetrates through the above-described secondary transfer through hole 185, and is engaged with a non-illustrative joint member of a secondary transfer driving unit 800 illustrated in FIG. 20. As a result, the secondary transfer roller 521 is rotationally driven by a driving force of the secondary transfer motor.

As illustrated in FIG. 18, on the inner circumferential surface of the locking through hole 184, lock receiving surfaces 182*a* and 182*b* are formed, as lock units on the side of the body. The lock receiving surfaces 182*a* and 182*b* are provided for locking the drawer unit 76 in the apparatus body unit 5, in contact with the rotational rollers 162 of the lock mechanism 160. Guiding surfaces 183*a* and 183*b* are respectively connected onto the side end part in the clockwise direction, of the illustration, of each of the lock receiving surfaces 182*a* and 182*b*. The guiding surfaces 183*a* and 183*b* guide the rotational rollers 162 of the lock mechanism 160 to the lock receiving surfaces 182*a* and 182*b*.

Figure 21A:
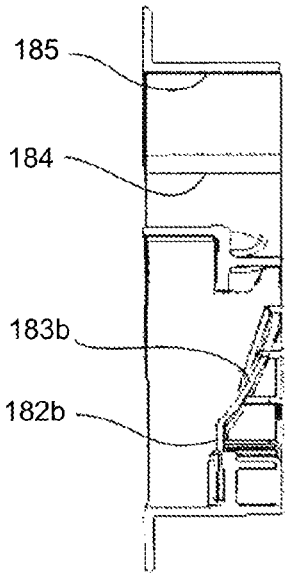
FIG. 21A is a cross-sectional view of the lock reception unit taken along A-A of FIG. 19.
Figure 21B:
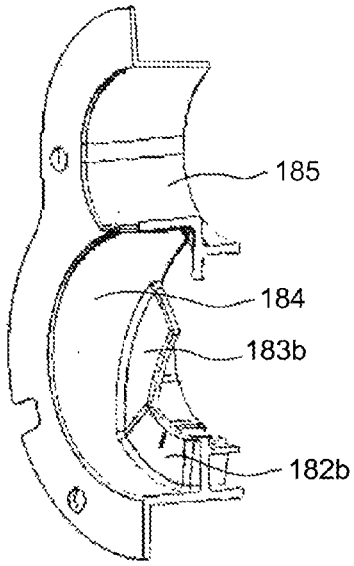
FIG. 21B is a cross-sectional perspective view of the lock receiving member taken along A-A of FIG. 19.

FIG. 21 are diagrams illustrating the lock receiving member taken along A-A of FIG. 19. FIG. 21A is a cross sectional view of the lock receiving member 180 seen from the side, and FIG. 21B is a cross-sectional perspective view of the lock receiving member.

As illustrated in FIG. 21, each of the guiding surfaces 183*a* and 183*b* has a tapered surface inclined toward the side of the drawer unit (forward), as away from the lock receiving surfaces 182*a* and 182*b*.

As illustrated in FIG. 18, cutouts 181*a* and 181*b* are formed on the side end part of the guiding surfaces 183*a* and 183*b* in the clockwise direction of the illustration. Into the cutouts 181*a* and 181*b*, the rotational rollers 162 of the lock mechanism 160 are inserted.

Inclined surfaces 186*a* and 186*b* (inclined forward) are formed on the side end part of the lock receiving surfaces 182*a* and 182*b*, in the counterclockwise direction of the illustration.

Figure 22:
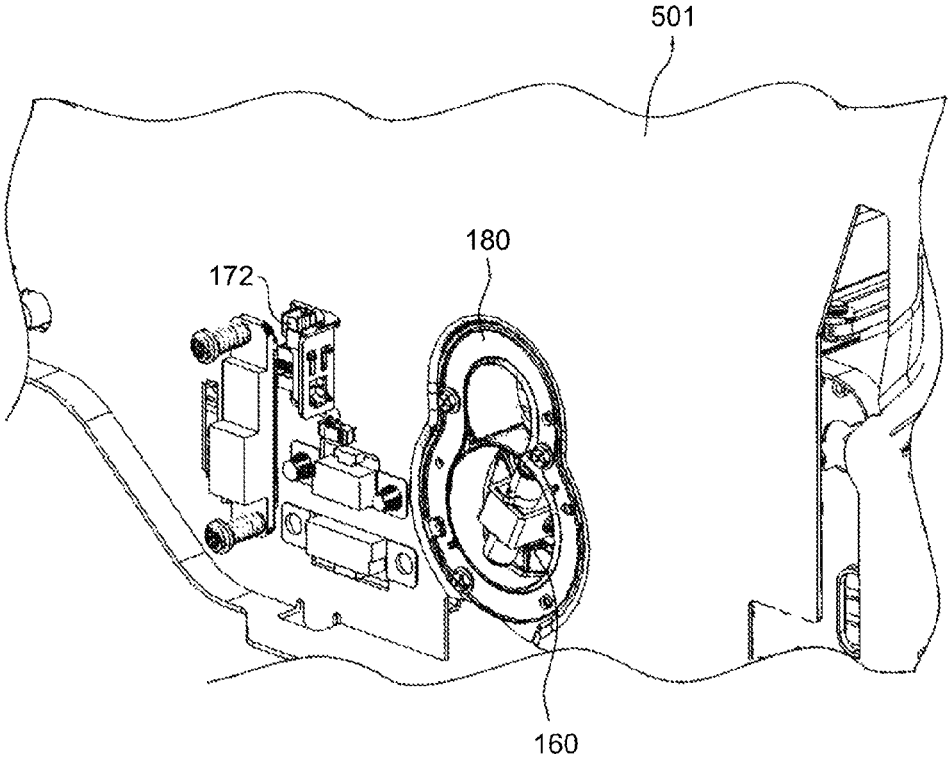
FIG. 22 is a perspective diagram illustrating a body rear plate.

As illustrated in FIG. 22, the cylindrical secondary transfer through hole 185 and locking through hole 184 of the locking receiving member 180 protrude to the side of the drawer unit 76 than the body rear plate 501. In this manner, the lock receiving member 180 is prevented from protruding from the opposite side surface of the side of the drawer unit of the body rear plate 501. As illustrated in FIG. 20, the secondary transfer driving unit 800 is screwed to the rear surface of the body rear plate 501 with a screw 801, to be opposed to the lock receiving member 180. When the lock receiving member 180 protrudes from the opposite surface from the drawer unit of the body rear plate 501, the secondary transfer driving unit 800 is necessarily away from the rear surface of the body rear plate 501, by a protruded length of the lock receiving member 180. This may result in enlargement of the apparatus in the drawing direction.

In the apparatus body unit 5, the body rear plate 501 is a member for positioning a process cartridge including photoreceptors, a transfer unit including the intermediate transfer belt 54, and a drawer unit 76 containing the fixing unit or the secondary transfer apparatus. Thus, the body rear plate 501 is fixed onto the rear side surface of the casing 40 (see FIG. 1) of the image reading unit 4. Accordingly, by fixing the body rear plate 501 on the rear side surface of the casing 40 of the image reading unit 4 (see FIG. 1), the body rear plate 501 can be fixed without being inclined toward the drawing direction, inside the apparatus body unit 5. This enables to perform positioning of the process cartridge, the transfer unit, and the drawer unit 76 in the apparatus body unit 5 with high efficiency. Generally, the length in the front-back direction of the image reading unit 4 is longer than the length in the width direction of images to be formed by this image forming apparatus. The length in the front-back direction of the drawer unit 76 is a little longer than the length in the width direction of images to be formed. Therefore, when the drawer unit 76 is attached to the apparatus body unit 5, there is some space between the drawer unit rear plate 151 and the body rear plate 501. Even if the lock receiving member 180 is made to protrude toward the side (front side) of the drawer unit of the body rear plate 501, the drawer unit rear plate 151 will not be the interference. Thus, by protruding the lock receiving member 180 to the side of the drawer unit of the body rear plate 501, it is possible to prevent enlargement of the apparatus in the drawing direction.

Descriptions will now be made to a lock detection mechanism as a lock detection unit which detects whether the drawer unit 76 is in a locked state or unlocked state.

Figure 23:
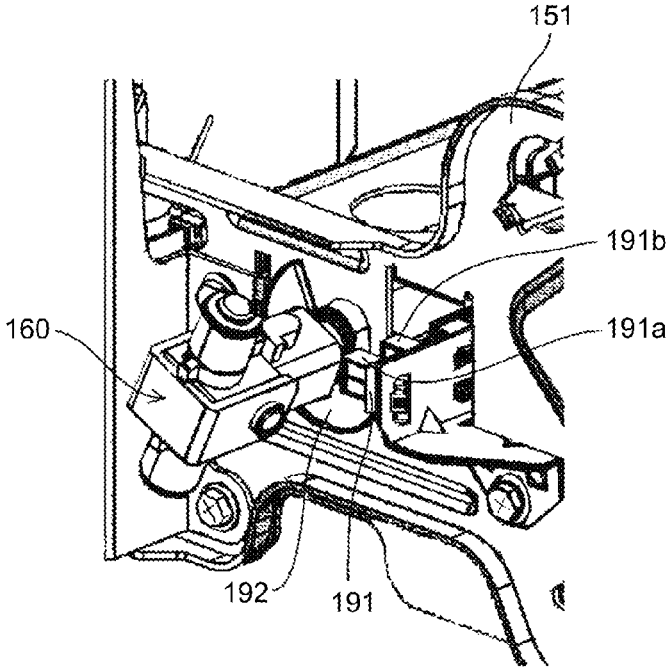
FIG. 23 is a perspective diagram illustrating a lock detection mechanism.

FIG. 23 is a perspective diagram illustrating the lock detection mechanism.

As illustrated in FIG. 23, the lock detection mechanism is attached to the lock shaft 703, and has a lock detection filler 192 and a lock detection sensor 191 of a photo-interrupter (transmission optical sensor). The filler 192 has a partial disc-like form. The lock detection filler 192 enters between a light receiving unit 191*b* and a light emitting unit 191*a* of the lock detection sensor 191, and blocks off the light of the light emitting unit 191*a*. As a result, the light receiving unit 191*b* does not detect light from the light emitting unit 191*a*, and a signal from the light receiving unit 191*b* will be OFF, that is, "shielded state". When the lock detection filler 192 does not exist between the light emitting unit 191*a* and the light receiving unit 191*b*, the light receiving unit 191*b* receives light from the light emitting unit 191*a*. As a result, a signal from the light receiving unit 191*b* will be ON, that is, "non-shielded state". Based on the ON/OFF signal from the light receiving unit 191*a*, a control unit 121 (see FIG. 24) understands if the drawer unit 76 is in a locked state or unlocked state.

Figure 24:
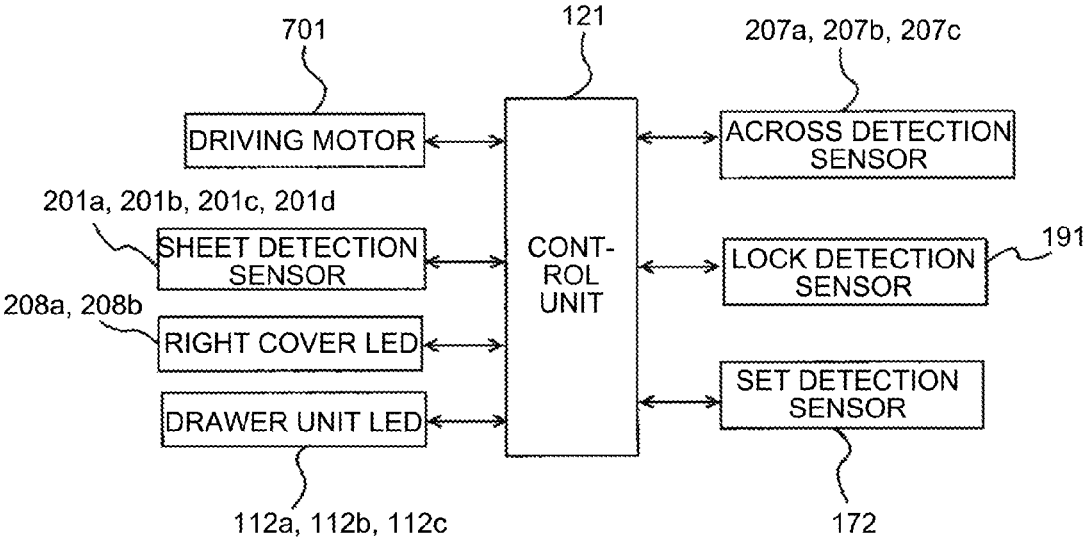
FIG. 24 is a functional block diagram illustrating an example of a main configuration of a control system.

FIG. 24 is a functional block diagram illustrating an example of a main configuration of this embodiment.

As illustrated in FIG. 24, the control unit 121 is connected to the driving motor 701, the sheet detection sensors 201*a* to 201*d*, and the drawer LEDs 112*a* to 112*c*. The control unit 121 is connected also to the across detection sensors 207*a* to 207*c*, the lock detection sensor 191, the set detection sensor 172, and the right cover LEDs 208*a* and 208*b*. Upon execution of, for example, a control program installed in advance, the control unit 121 controls the driving motor 701, controls the lock of the drawer unit 76, and turns on the drawer LEDs 112*a* to 112*c* and the right cover LEDs 208*a* and 208*b*.

Descriptions will now be made to a locking operation of the drawer unit 76.

Figure 25:
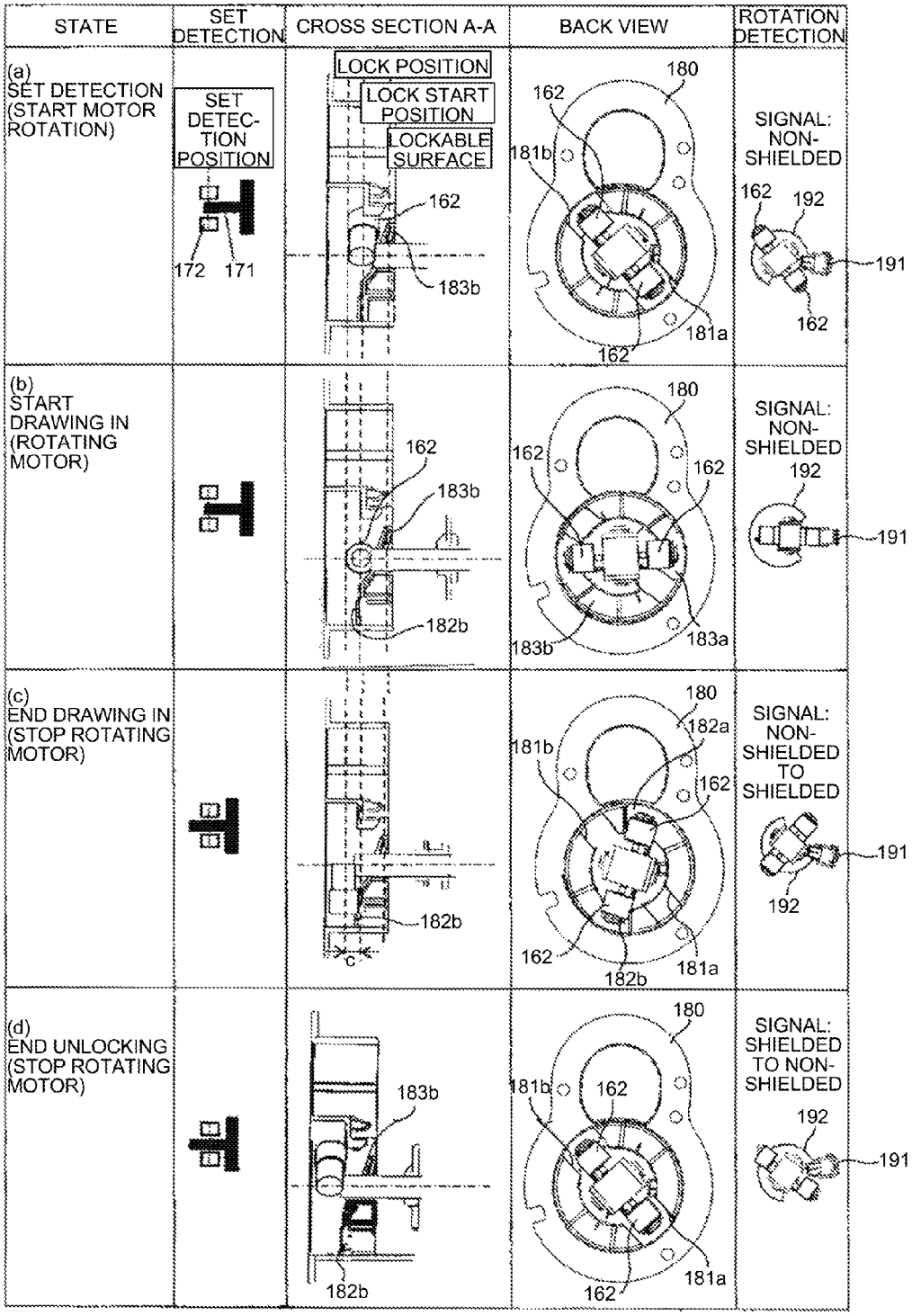
FIG. 25 is a diagram for explaining states of a set detection mechanism and a lock detection mechanism, at the transition from an unlocked state to a locked state.
Figure 26:
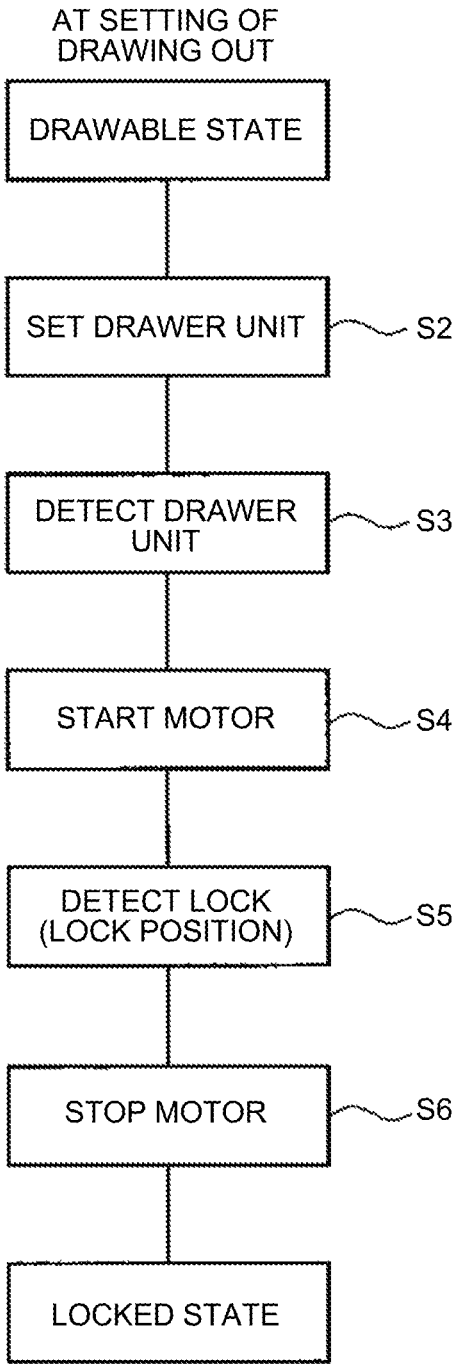
FIG. 26 is an operation flow diagram at the transition from an unlocked state to a locked state.

FIG. 25 is a diagram for explaining a state of a set detection mechanism and a lock detection mechanism, at the transition from the unlocked state to the locked state. FIG. 26 is an operation flow diagram at the transition from the unlocked state to the locked state.

As illustrated in FIG. 25A, after the drawer unit 76 is unlocked, in a state where the drawer unit 76 is drawable, the rotational rollers 162 of the lock mechanism 160 are in positions corresponding to the cutouts 181*a* and 181*b* of the lock receiving member 180. When it is in the unlocked state, the lock detection filler 192 of the lock detection mechanism is just in a position out of the part opposed to the light receiving unit 191*b* and the light emitting unit 191*a* of the lock detection sensor 191. Thus, at this time, the light receiving unit

191*b* of the lock detection sensor detects light of the light emitting unit 191*a*, and it is ON, that is, non-shielded state. At this time, the secondary transfer roller 521 is in a separated position from the intermediate transfer belt 54, while the link mechanism 710 is in a state as illustrated in FIG. 12.

From this state, if the drawer unit 76 is set to the apparatus body unit 5 (S2), the lock mechanism 160 is inserted into the locking through hole 184 of the lock receiving member 180. When the rotational rollers 162 are moved to the rear side than the side end part of the drawer unit of the guiding surfaces 183*a* and 183*b*, the set detection filler 171 enters between the light receiving unit 172*b* and the light emitting unit 172*a* of the set detection sensor 172, and blocks off light of the light emitting unit 172*a*. This enables that the set detection unit detects that the drawer unit 76 has been set (S3), the driving motor 701 illustrated in FIG. 11 starts to be driven (S4), and the lock shaft 703 is rotated.

When the lock shaft 703 is rotated, as illustrated in FIG. 25B, the rotational rollers 162 of the lock mechanism 160 come into contact with the guiding surfaces 183*a* and 183*b*, and are moved to the lock receiving surfaces 182*a* and 182*b* on the rear side, while being guided by the guiding surfaces 183*a* and 183*b*. In this manner, if the rotational rollers 162 are moved to the rear side while being guided by the guiding surfaces 183*a* and 183*b*, the lock shaft 703 is drawn to the rear side. As illustrated in FIG. 10, the E ring 722 is fixed to a groove of the lock shaft 703, to come into contact with the front side surface of the drawer unit rear plate 151. If the lock shaft 703 is to be moved to the rear side, the drawer unit rear plate 151 is pressed to the rear side by the E ring 722, and the drawer unit 76 is drawn to the apparatus body unit 5.

The above-described attachment/detachment mechanism is driven through the lock shaft 703 and the link mechanism 710, and the secondary transfer roller 521 is moved from the separated position to the contact position.

Because the rotational rollers 162 are rotationally attached to the roller shaft 161, the rotational rollers 162 can move on the guiding surfaces 183*a* and 183*b* while being rotated. As a result, it is possible to prevent an increase in the frictional resistance of the guiding surfaces 183*a* and 183*b*, and thus smoothly drawing the drawer unit to the rear side.

In the configuration of this embodiment, after the lock mechanism 160 starts the drawing operation, the positioning pin 152 is fit into the positioning hole 502 for positioning. Before the drawing operation is started (the set detection filler 171 is detected by the set detection sensor 172), if the fitting unit 152*b* of the positioning pin 152 is configured to be fit into the positioning hole 502, the fitting unit 152*b* is fit into the positioning hole 502 while the drawer unit 76 is manually pushed in. As a result, in the middle of the manual pushing, the resistance increases at the pushing in. Thus, the user may misunderstand that the pushing is done up to the drawing start position, and stop the pushing in of the drawer unit.

In the configuration of this embodiment, after the lock mechanism 160 starts the drawing, the positioning pin 152 is fit into the positioning hole 502, for positioning. Until the drawer unit 76 is pushed into the drawing start position (the position that the set detection sensor 172 detects the set detection filler 171) by the lock mechanism 160, it is possible to prevent a rapid increase of the pushing resistance. As a result, the drawer unit can manually be pushed into the drawing start position by the lock mechanism 160.

In the configuration in which connectors are provided for the drawer unit 76 and the apparatus body unit, and the drawer unit is set to the apparatus body, the connector of the drawer unit is fit into the connector of the apparatus body, and thus turning on electricity. In this case, the driving motor 701 cannot be driven, unless the connectors are fit with each other. When the connectors are fit with each other, the pushing resistance of the drawer unit increases. Therefore, the user may misunderstand that the pushing is done up to the drawing start position, and stop the pushing in of the drawer unit.

However, in this embodiment, even in a state where the drawer unit 76 is drawn out with the binding wire 105, the drawer unit 76 is in an electrically-conducted state, enabling to drive the driving motor 701. As compared to a configuration in which electrical conduction is made by fitting the connector of the drawer unit is fit into the connector of the apparatus body, the drawer unit can certainly be pushed into the drawing start position by hand. After the positioning pin 152 is fit into the positioning hole 502, the drawer unit 76 is drawn to the rear side by the guiding surfaces 183*a* and 183*b*, and the bearing surface part 152*c* of the positioning pin 152 formed on the drawer unit rear plate 151 comes up against the body rear plate 501. As illustrated in FIG. 25C, when the rotational rollers 162 of the lock mechanism 160 reach the lock receiving surfaces 182*a* and 182*b*, the lock detection filler 192 enters between the light receiving unit 191*b* and the light emitting unit 191*a* of the lock detection sensor, and it will be OFF, that is, in a shielded state. Then, the lock detection mechanism detects that the drawer unit 76 is locked in the apparatus body unit 5 (S5), and the driving of the driving motor 701 is stopped (S6). At this time, the secondary transfer roller is in contact with the intermediate transfer belt 54 at a predetermined pressure. At this time, the link mechanism 710 is in a state as illustrated in FIG. 27.

In this embodiment, after the bearing surface part 152*c* of the positioning pin 152 formed on the drawer unit rear plate 151 comes up against the body rear plate 501, the drawer unit 76 is drawn to the rear side by 0 to 1 mm, and the drawer unit 76 is locked in the apparatus body. This enables to lock the drawer unit 76 in the apparatus body unit 5, without being unsteadily in the front-back direction. As a result, it is possible to prevent the image deterioration due to shaking at the image formation. Deflection may occur in the horizontally long drawer unit rear plate 151 and body rear plate 501, and elastic deformation may occur in any of those formed of resin, of members coming up against the body rear plate 501 of the drawer unit 76. In any of these cases, after the bearing surface part 152*c* of the positioning pin 152 comes up against the body rear plate 501, the drawer unit 76 is possibly drawn to the rear side by 0 to 1 mm.

As will be described later, when a jam occurs, and it is necessary to draw out the drawer unit 76, the driving motor 701 is rotated, and the lock mechanism 160 is rotated in a counterclockwise in the illustration. Then, the rotational rollers 162 are moved to the inclined surfaces 186*a* and 186*b* from the lock receiving surfaces 182*a* and 182*b*. As illustrated in FIG. 25D, when the rotational roller 162 in contact with the lock receiving surface 182*a* reaches the position of the cutout 181*a*, and also the rotational roller 162 in contact with the lock receiving surface 182*b* reaches the position of the cutout 181*b*, the lock detection filler 192 does not exist between the light receiving unit 191*b* and the light emitting unit 191*a* of the lock detection sensor. As a result, it is switched from OFF (shielded state) to ON (non-shielded state), and the lock detection mechanism can detect that the lock of the drawer unit 76 has been released.

Figure 27:
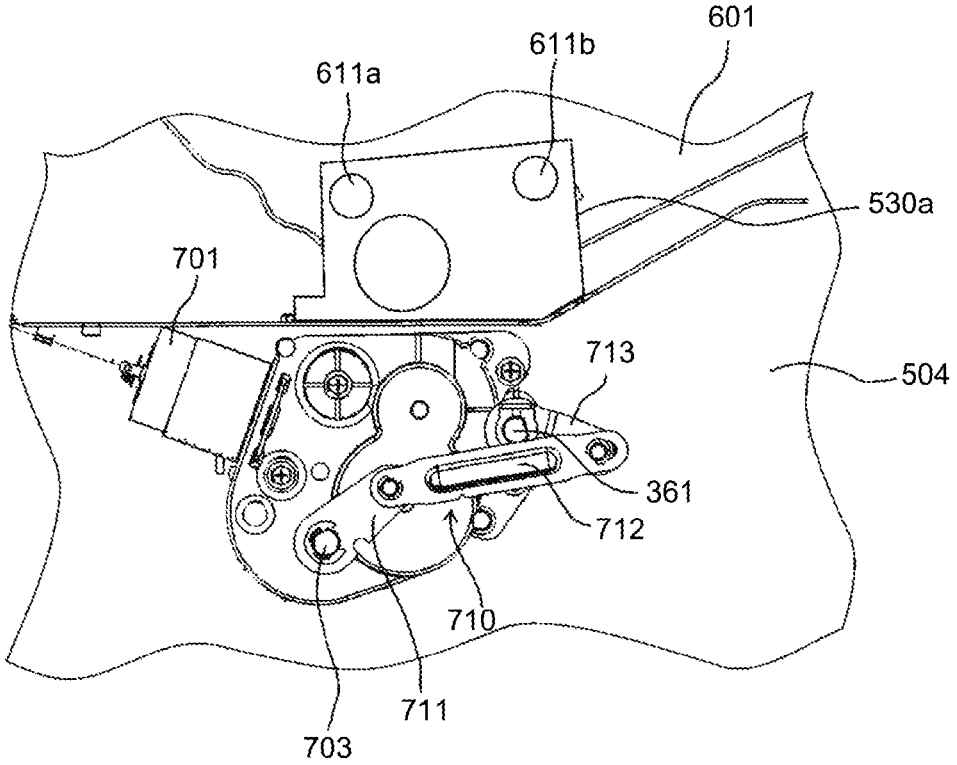
FIG. 27 is a front view of the driving unit when the drawer unit is locked.

From the state illustrated in FIG. 27, if the lock shaft 703 is rotated in a clockwise direction of FIG. 27, the rotational direction of the input shaft 361 is switched into a clockwise direction in FIG. 27, after the input shaft 361 is a little rotated in the counterclockwise direction in FIG. 27. Then, the secondary transfer roller 521 is switched from a direction approaching the intermediate transfer belt 54 into a direction separating therefrom. When the lock is released, the link mechanism 710 is in the state as illustrated in FIG. 12, and the secondary transfer roller 521 reaches a position separated from the intermediate transfer belt 54.

Accordingly, in this embodiment, the drawer unit can automatically be locked and unlocked. Thus, the jam process can easily be performed, as compared to a case where the drawer unit is locked and unlocked with using a lever provided in the drawer unit. As a result, it is possible to improve efficiency of the jam process.

The attachment/detachment of the secondary transfer roller 521 to/from the intermediate transfer belt 54 is performed together with the locking operation of the drawer unit 76. When the drawer unit 76 is in a state where it can be drawn out, the secondary transfer roller 521 can be in a state that it can surely be separated from the intermediate transfer belt 54. Thus, when the drawer unit 76 is drawn out from the apparatus body, the secondary transfer roller 521 can be prevented from rubbing on the intermediate transfer belt 54, and it is possible to prevent a scar from being made on the surface of the secondary transfer roller 521 or the surface of the intermediate transfer belt 54. In addition, the secondary transfer roller 521 will not be left without being in contact with the intermediate transfer belt 54.

By the driving of the driving motor 701, the drawer unit 76 is automatically unlocked, and the secondary transfer roller 521 is separated from the intermediate transfer belt 54. This enables to easily perform the drawing out of the drawer unit 76.

In the configuration of this embodiment, as illustrated in FIG. 2, the front cover 6 is fixed to the drawer unit 76, and the front cover 6 is drawn out together with the drawer unit 76. In this configuration, if the drawer unit 76 is configured to be manually locked and unlocked, the operation unit is necessarily provided in a position exposed from the apparatus. This results in an unattractive appearance of the apparatus. Hence, for example, an operation unit may be provided in the handle unit 6*a*. The operation unit is to lock and unlock the drawer unit. Specifically, in the configuration, if the user holds the handle unit 6*a*, the operation unit is pressed to unlock the unit. However, in this embodiment, as described above, after the bearing surface unit 152*c* of the positioning pin 152 comes up against the body rear plate 501, the drawer unit 76 is drawn to the rear side by 0 to 1 mm, to be locked. A great force is necessary for moving the rotational rollers 162 from the lock receiving surfaces 182*a* and 182*b*, to be unlocked, and moving the guiding surfaces 183*a* and 183*b* to be locked. In this manner, to realize a configuration in which the drawer unit 76 locked firmly in the apparatus body 5 can be locked and unlocked easily by a user operation on the operation unit, the large operation quantity of the operation unit is required. In a case where the drawer unit 76 firmly locked in the apparatus body unit 5 is locked or unlocked through the same operation quantity as that for holding the handle unit 6*a*, a great force is required for the operation, and thus not realizing easy movement of the operation unit.

In this embodiment, however, the lock and unlock of the drawer unit are automatically performed, thereby preventing unattractive appearance of the apparatus.

In the configuration in which the lock shaft 703 is easily rotated, the lock shaft 703 may undesirably be rotated at the attachment of the drawer unit 76. When the drawer unit 76 is attached, if the lock shaft 703 is rotated, the rotational rollers 162 of the lock mechanism 160 are not inserted into the cutouts 181*a* and 181*b*, and come up against the guiding surfaces 183*a* and 183*b*. This results in that the drawer unit 76 cannot be attached. When the drawer unit 76 is attached to the apparatus body unit 5, the lock shaft 703 is rotated due to the shaking. This may result in unlocking of the drawer unit. Therefore, in this embodiment, the high-torque worm gear 704 is used, and this gear has a large speed reduction ratio in the driving transmission from the driving motor 701 to the lock shaft 703. With using the worm gear 704, the lock shaft 703 is not easily rotated. This can prevent a problem that the drawer unit 76 is not possibly attached to the apparatus, or the lock is released due to the shaking.

In this embodiment, as illustrated in FIG. 17, the set detection sensor 172 is arranged in the vicinity of the lock receiving member 180. When the set detection sensor 172 is arranged in a position away from the lock receiving member 180, the following problem may occur. That is, the set detection sensor 172 may undesirably detect the filler 171 before the rotational rollers 162 are positioned on the rear side than the guiding surfaces 183*a* and 183*b*, due to an effect of the deformation of the drawer unit rear plate 151 or the deformation of the body rear plate 501.

Like the embodiment, the set detection sensor 172 is arranged in the vicinity of the lock receiving member 180, thereby preventing the effect of the deformation of the drawer unit rear plate 151 or the deformation of the body rear plate 501. As a result, it is possible to prevent a problem that the set detection sensor 172 detects the filler 171 before the rotational rollers 162 are positioned on the rear side than the guiding surfaces 183*a* and 183*b*.

In this embodiment, when the lock is released, the rotational rollers 162 are guided from the lock receiving surfaces 182*a* and 182*b* to the inclined surfaces 186*a* and 186*b*, and are moved to the cutouts 181*a* and 181*b*. In this manner, by providing the inclined surfaces 186*a* and 186*b*, it is possible to prevent a sudden change of the torque, and restrain the load on the driving motor 701.

Figure 28:
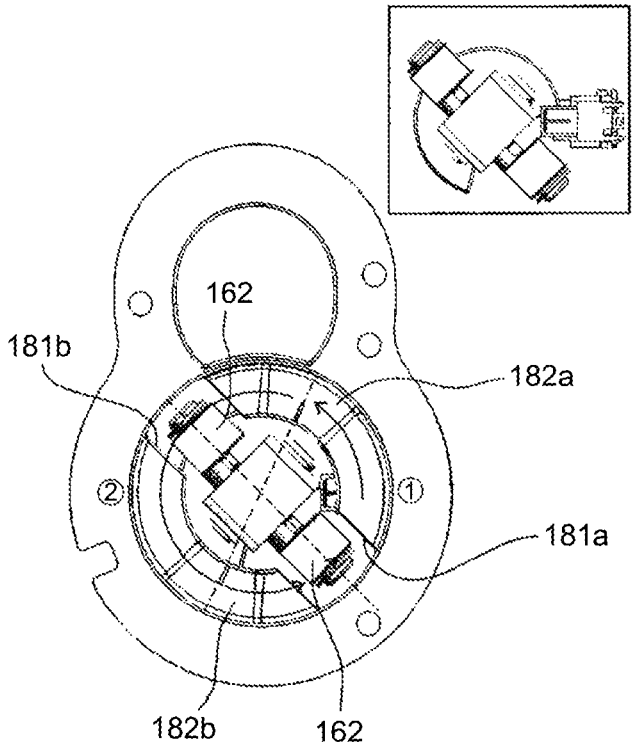
FIG. 28 is a diagram for explaining the movement of a rotational roller at the transition from the locked state to the unlocked state.

In this embodiment, as illustrated in FIG. 28, operations of "unlocking" to "locking" to "unlocking" are performed through one rotational operation of the lock shaft 703. This is because, as described using FIG. 12 and FIG. 27, the rotational direction of the input shaft 361 is switched in the one rotational operation of the lock shaft 703, and the secondary transfer roller 521 is attached/detached to/from the intermediate transfer belt 54, using the link mechanism 710. Thus, when the locking of the drawer unit 76 and the attachment/detachment of the secondary transfer roller 521 are individually performed, a configuration illustrated in FIG. 29 may be used.

Figure 29:
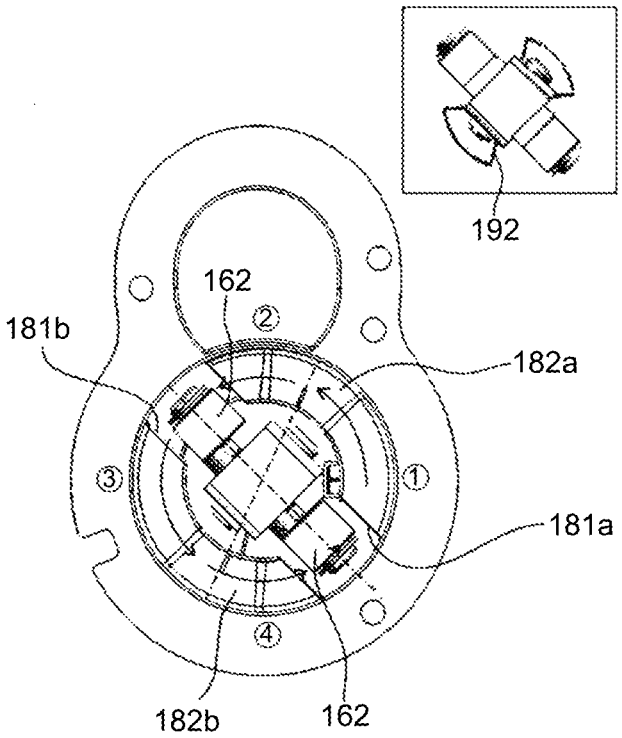
FIG. 29 is a diagram illustrating a state where the flow of "unlocking" to "locking" to "unlocking" is executed along the half rotation movement of a lock shaft.

As illustrated, the configuration illustrated in FIG. 29 is to perform the operations of "unlocking" to "locking" to "unlocking" through a half rotation operation of the lock shaft 703. Thus, the lock detection filler 192 of the lock detection mechanism is in a fan-shaped form, and two of the fillers are formed at a space of 180° in the circumferential direction of the lock shaft 703. According to this configuration, at the stage that the rotational roller 162 in contact with the lock receiving surface 182*a* reaches the cutout 181*b*, the lock detection sensor 191 is switched from OFF "shielded state" to ON "non-shielded state", and detects that the lock has been released. According to this configuration, it is possible to reduce a transition time from the locked state to the unlocked state.

Figure 30:
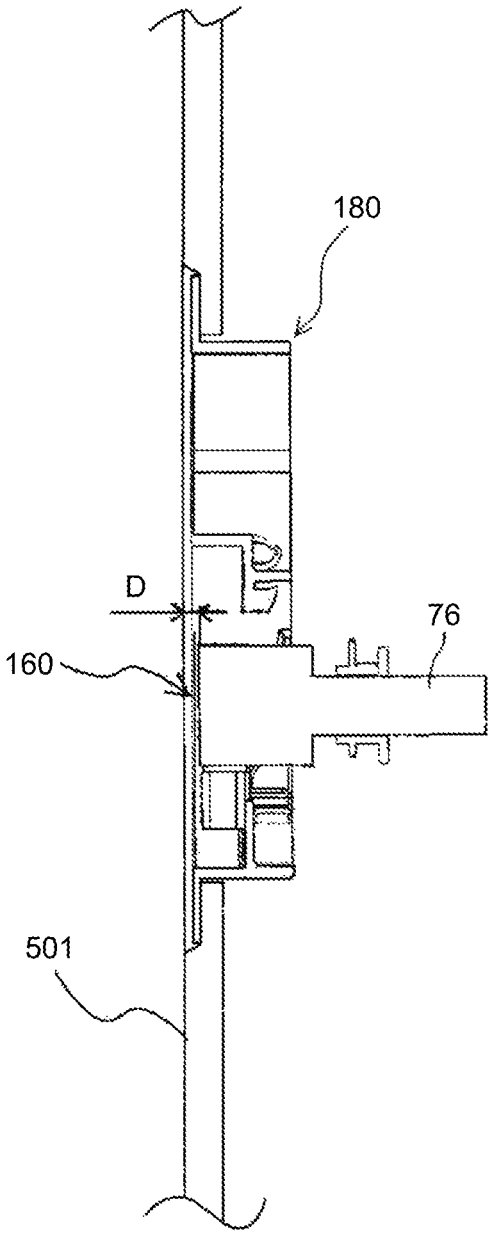
FIG. 30 is a diagram for explaining the positional relationship, in the drawing direction, of the lock reception member and the lock mechanism in the locked state.

In this embodiment, as illustrated in FIG. 30, in a state where the drawer unit 76 is locked, the rear side part of the lock mechanism 160 is positioned on the front side than the rear side surface of the body rear plate 501 by a distance D. That is, when it is locked in the apparatus body, the lock mechanism 160 is set not to protrude from the rear surface of body rear plate 501. Thus, it is possible to provide the secondary transfer driving unit 800 in contact with the rear surface of the body rear plate 501. This unit 800 is opposed to the lock receiving member 180, as illustrated in FIG. 20. As a result, the image forming apparatus can be miniaturized in its front-back direction.

Figure 31:
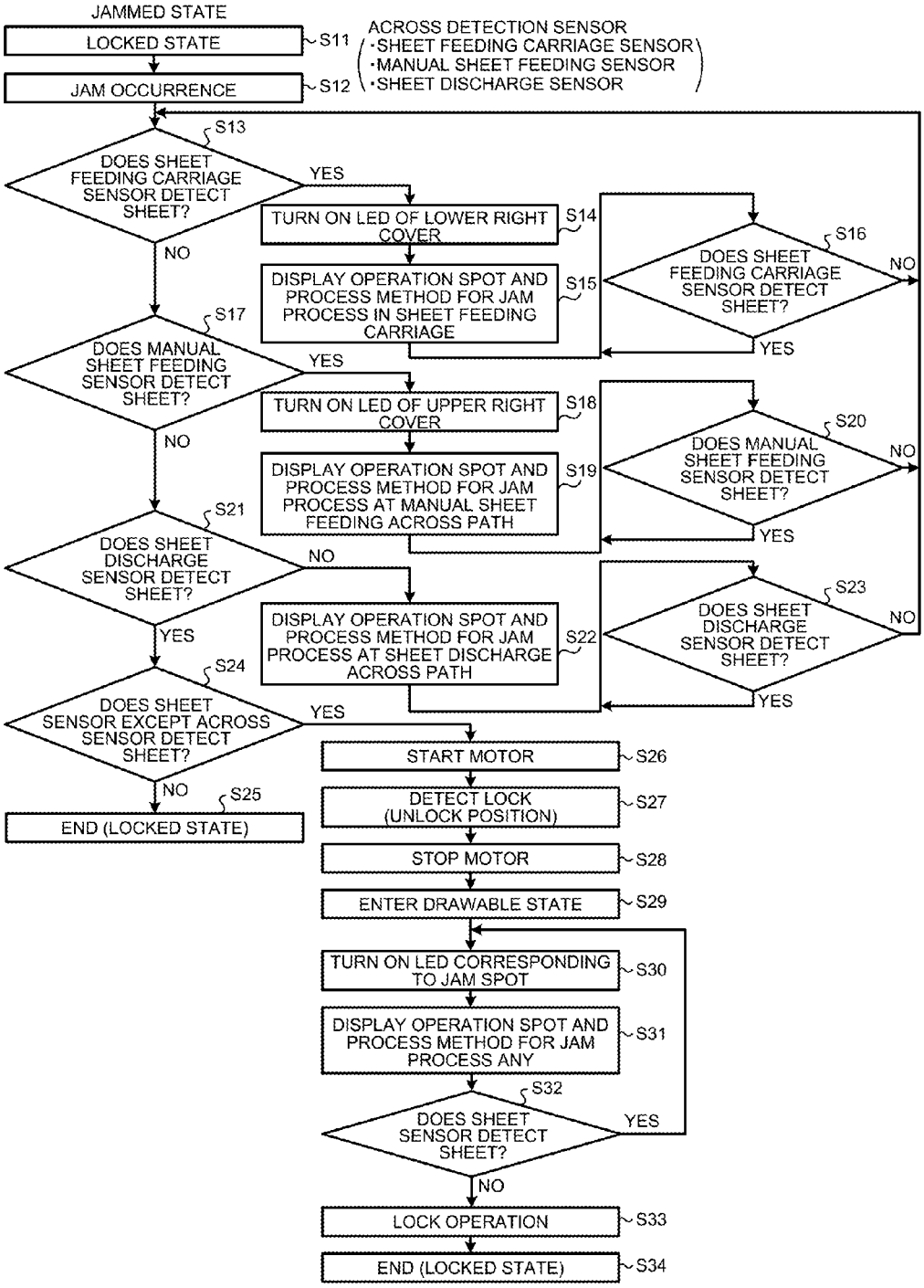
FIG. 31 is an operation flow diagram at the jam occurrence.

FIG. 31 is an operation flow diagram at the jam occurrence.

When an image forming operation is performed, the drawer unit 76 is locked in the apparatus body unit 5 (S11). Driving of each carriage roller is stopped, upon detection of occurrence of the sheet jam by any of a plurality of sheet detection sensors arranged along the carriage path, such as the main carriage path 70 or the reversing carriage path 73 (S12). The control unit 121 checks whether the sheet feeding carriage sensor 207*a* as an across detection sensor has detected a sheet of paper (S13).

When the sheet feeding carriage path sensor 207*a* detects a sheet of paper (S13: Yes), there exists a sheet of paper at the sheet feeding path across part A illustrated in FIG. 5. Therefore, at this time, the lower right cover LED 208*a* provided on the right cover member of the sheet feeding unit 3 is turned on, or a non-illustrative operation display unit displays information representing the existence of the sheet of paper at the sheet feeding path across part A, representing a spot for a jam process, or a jam process method (S15). As a result, the user is informed of it. The user visually checks a non-illustrative operation display unit and the lighted lower right cover 208*a*, opens up the right cover member of the sheet feeding unit 3, and removes the sheet of paper at the sheet feeding path across part A. When the jam process is completed by the user, and the sheet feeding carriage sensor 207*a* does not detect the sheet of paper (S16: No), the lower right cover LED 208*a* is turned off, and the operation display unit turns off the display.

When the sheet feeding carriage sensor 207*a* does not detect a sheet of paper (S13: No), the control unit 121 checks whether the manual sheet feeding sensor 207*b* detects a sheet of paper (S17). When the manual sheet feeding sensor 207*b* detects a sheet of paper (S17: Yes), there exists a sheet of paper at the manual path across part B illustrated in FIG. 5. Therefore, at this time, the upper right cover LED 208*b* is turned on. This LED is provided on the right cover member of the apparatus body unit 5. The non-illustrative operation display unit displays information representing that a sheet of paper exists at the manual path across part B, representing a spot for a jam process, and also representing a jam process method (S19). The user follows the contents of the non-illustrative operation display unit, visually checks the lighted lower right cover LED 208*a*, and removes the sheet of paper lying across the manual path across part B. When the sheet of paper lies across the manual path across part B, the rear end of the sheet of paper is on the manual feed tray 32. Thus, the user holds the rear end of the sheet on the manual feed tray, draws out it therefrom, thereby performing the jam process. After removal of the sheet at the manual path across part B, the manual sheet feeding sensor 207*b* does not detect a sheet of paper (S20: No). At this time, the upper right cover LED 208*b* is turned off, and the operation display unit turns off the display.

When the sheet feeding carriage sensor 207*a* and the manual sheet feeding sensor 207*b* do not detect a sheet of paper (S13: No, S17: No), a check is made as to whether the sheet discharge sensor 207*c* detects a sheet of paper (S21). When the sheet discharge sensor 207*c* detects a sheet of paper (S21: Yes), there exists a sheet of paper at the discharge path across part C illustrated in FIG. 5. At this time, the non-illustrative operation display unit displays information representing the existence of the sheet of paper at the discharge path across part C, representing a spot for jam process, and also representing a jam process method, to notify the user about it (S22). The user removes the sheet of paper at the discharge path across path C in accordance with an instruction of the non-illustrative operation display unit. When the sheet of paper lies across the discharge path across part C, the head end of the sheet of paper is on the sheet discharge tray 61. Therefore, the user holds the head end of the sheet of paper on the sheet discharge tray, and draws out it therefrom, thereby performing the jam process. After removal of the sheet of paper at the discharge path across part C, if the sheet discharge sensor 207*c* does not detect a sheet of paper (S23: No), the operation display unit turns off the display. An LED may be provided on the left cover member of the apparatus body unit 5. In this case, when the sheet discharge sensor 207*c* detects a sheet of paper, the LED is turned on to display a spot for removing the sheet of paper at the discharge path across part C.

When any of the sheet feeding carriage sensor 207*a*, the manual sheet feeding sensor 207*b*, and the sheet discharge sensor 207*c* does not detect a sheet of paper (S13: No, S17: No, S21: No), a check is made as to whether any of the plurality of sheet detection sensors arranged along the carriage path of the drawer unit 76 detects a sheet of paper (S24). When the sheet detection sensor of the drawer unit does not detect a sheet of paper (S24: No), the jam process is ended (S25).

When the sheet detection sensor of the drawer unit detects a sheet of paper (S24: Yes), an operation for unlocking the drawer unit 76 is executed. That is, as described above, the driving motor 701 is driven, and the rotational rollers 162 in contact with the lock receiving surfaces 182*a* and 182*b* are moved to the positions of the cutouts 181*a* and 181*b*. The lock detection sensor 191 is switched from OFF "shielded state" to ON "non-shielded state", and detects that the lock has been released (S27). Then, the driving motor 701 is stopped (S28), and the drawer unit 76 can now be drawn out (S29).

Now, the drawer unit LEDs 112*a* to 112*c* illustrated in FIG. 4 are turned on, based on a detection result of the sheet detection sensor arranged along the carriage path of the drawer unit 76 (S30). In addition, the non-illustrative operation display unit displays a spot for a jam process and a jam process method, to notify the user about it (S31). For example, when the set detection sensor 172 detects that the drawer unit 76 has been set, the operation display unit displays an instruction to draw out the drawer unit 76. An LED may be provided on the upper part of the handle unit 6*a* of the front cover 6, and turned on to show an operation spot to the user. When the user draws out the drawer unit 76, the set detection sensor 172 does not detect that the drawer unit 76 has been set. In this case, the operation display unit displays a procedure for removing the sheet of paper in the drawer unit.

The user removes the sheet of paper in the carriage path of the drawer unit 76, in accordance with the instruction on the operation display unit or based on lighting of the drawer unit LEDs 112*a* to 112*c*. Then, when any of the plurality of sheet detection sensors arranged along the carriage path of the drawer unit 76 does not detect a sheet of paper (S32: No), the operation display unit displays information to close the drawer unit 76. The lock operation flow illustrated in FIG. 26 is executed (S33), to lock the drawer unit 76, and the jam process is ended (S34).

Accordingly, in this embodiment, when any of the sheet feeding carriage sensor 207*a*, the manual sheet feeding sensor 207*b*, and the sheet discharge sensor 207*c* detects a sheet of paper, the drawer unit 76 is in a locked state. Thus, the drawer unit 76 is not possibly drawn out, in a state where a sheet of paper lies across at the sheet path across part A, the manual path across part B, and the discharge path across part C. This can prevent that the sheet of paper is torn off. Further, in this embodiment, only when the sheet of paper is stuck in the carriage path in the drawer unit 76, the drawer unit 76 is unlocked, and the unit can be drawn out. As a result, it is possible to prevent that the drawer unit 76 is needlessly drawn out and the parts of the drawer unit 76 get damaged.

In this embodiment, the work spot for a jam process is shown by the operation display unit or LED, thereby appropriately executing the jam process. This can prevent that the user draws out the locked drawer unit 76.

Descriptions will now be made to feature points of this embodiment.

As described above, in the configuration of this embodiment, the front cover 6, as an outer cover, is attached to the drawer unit front plate 150. The front cover 6 is drawn out, to draw out the drawer unit 76. In this embodiment, the lock mechanism 160 is rotationally driven by the driving motor 701, to lock and unlock the drawer unit 76. The lock shaft 703 is not easily rotated by the driving force of the driving motor 701, because the high-torque worm gear 704 is used. Note that this gear has a large speed reduction ratio.

According to this configuration, if the driving motor 701 is damaged in a state where the drawer unit 76 is locked in the apparatus body unit 5, the drawer unit 76 is not possibly drawn out from the apparatus body unit 5. It can be considered to provide a mechanism for manually releasing the lock, when the driving motor 701 is damaged. However, in the configuration of this embodiment, using the high-torque worm gear 704 with a large reduction ratio, the lock shaft 703 is not easily rotated. Therefore, it is difficult to easily and manually rotate the lock shaft 703. Accordingly, in this embodiment, when the driving motor 701 is damaged, the drawer unit 76 is not possibly drawn out from the apparatus body. Thus, in a state where the drawer unit 76 is locked in the apparatus body, the only way to replace the driving motor 701 is to remove the front cover 6 from the drawer unit 76 and expose the driving motor 701 therefrom.

In the configuration of this embodiment, in a state where the drawer unit 76 is locked in the apparatus body, the front cover 6 can be removed from the drawer unit 76. Specific descriptions will hereinafter be made.

Figure 32:
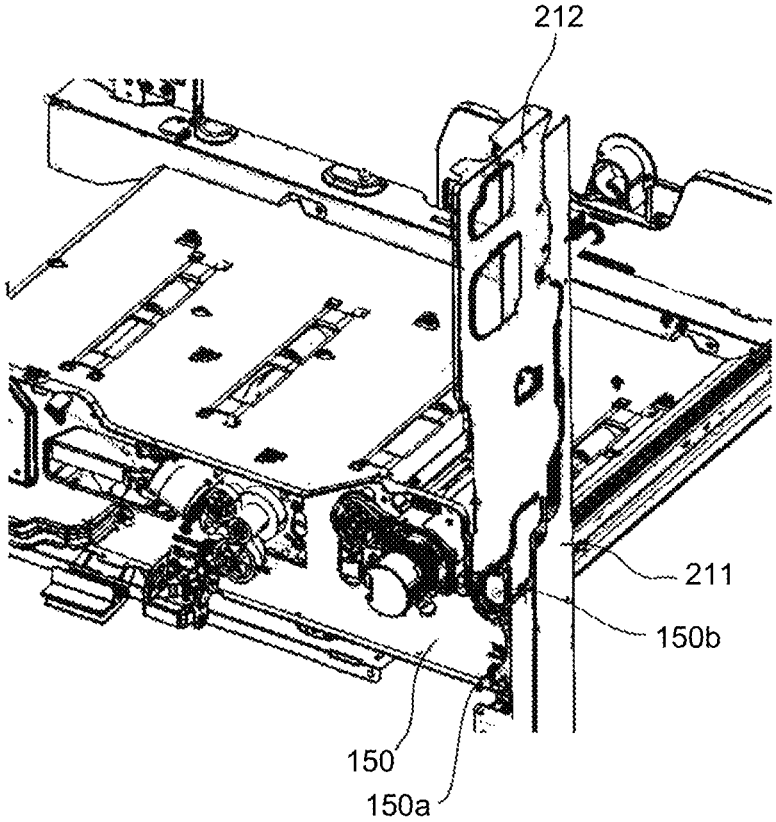
FIG. 32 is a main part perspective view illustrating the drawer unit and structures of the apparatus body.

FIG. 32 is a main part perspective diagram illustrating the drawer unit 76 and structures of the apparatus body unit 5.

As illustrated in FIG. 32, on the right end part in the illustration, the drawer unit front plate 150, a right-side first screw hole 150*a*, and a right-side second screw hole 150*b* are provided to screw the right side of the front cover 6. Though not illustrated, on the left end part (the side end part of the sheet discharge path 60) of the drawer unit front plate 150, a left-side first screw hole and a left-side second screw hole are provided to screw the left side of the front cover 6.

A reinforcement frame 212 is attached to a right-side supporting frame 211 elongated in a vertical direction of the structures of the apparatus body unit 5. The frame 212 supports the image reading unit 4.

Figure 33:
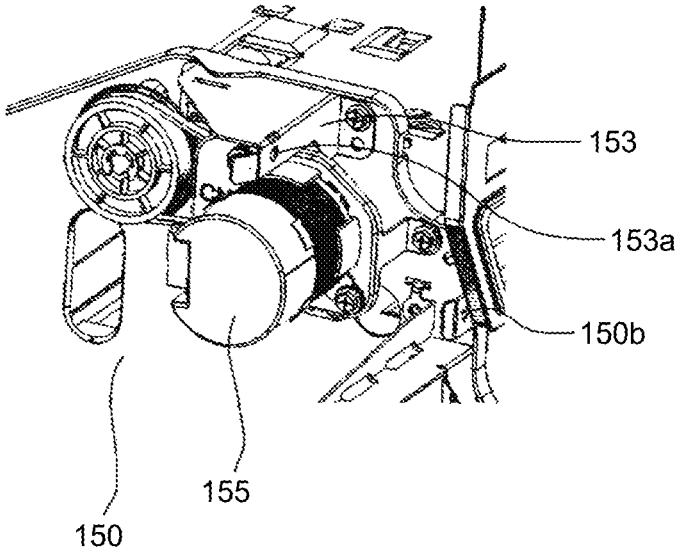
FIG. 33 is an enlarged perspective view illustrating the right vicinity of the front side plate of the drawer unit.

FIG. 33 is an enlarged perspective diagram illustrating the vicinity on the right side (side of the main carriage path 70) of the drawer unit front plate 150.

As illustrated in FIG. 33, a carriage motor 155 is attached into the vicinity of the right end part of the drawer unit front plate 150. This motor rotationally drives the resist rollers 70*a*. A first cover attachment member 153 is arranged above the carriage motor 155. This member 153 is to fasten the front cover 6 to the drawer unit 76 from the right side. The first cover attachment member 153 is screwed to the drawer unit front plate 150. The first cover attachment member 153 has a surface parallel to the right side surface, and a right-side third screw hole 153*a* is provided thereon.

Figure 34:
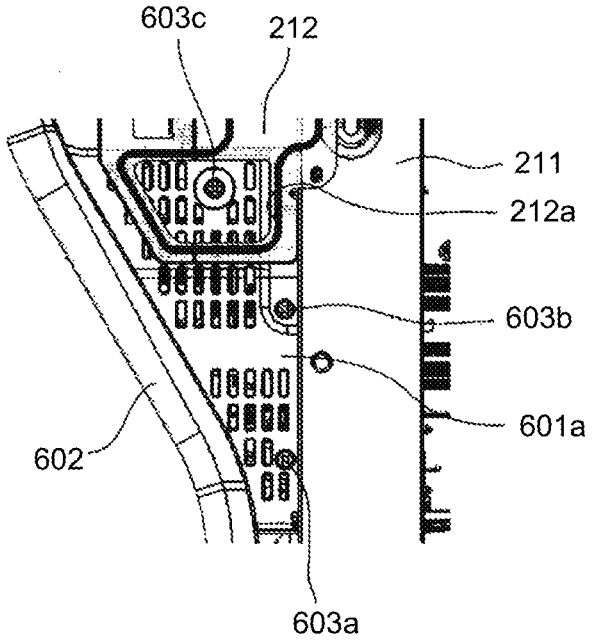
FIG. 34 is an enlarged diagram illustrating the vicinity of the front cover, when a right cover of the apparatus body unit is removed.
Figure 35:
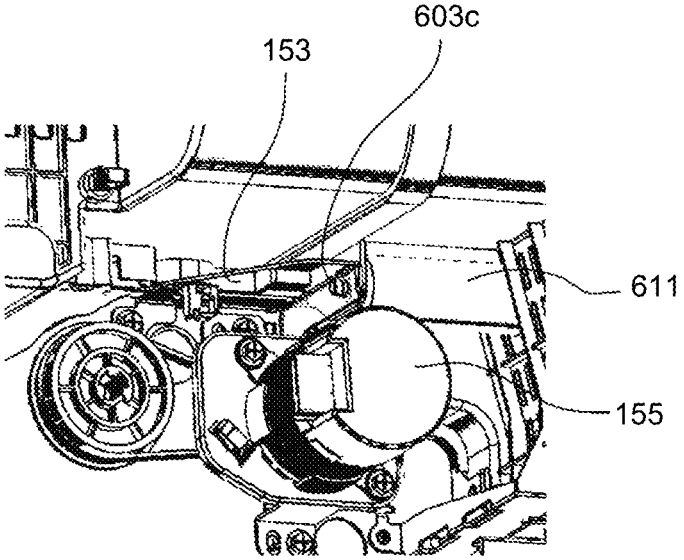
FIG. 35 is a perspective diagram illustrating a state where the front cover is screwed to a first cover attachment member.

FIG. 34 is an enlarged diagram illustrating the vicinity of the front cover, when the right-side cover of the apparatus body unit is removed therefrom, and FIG. 35 is a perspective diagram illustrating a state where the front cover 6 is screwed to the first cover attachment member 153.

As illustrated in FIG. 34, a right-side surface 601*a* of an inner cover part of the front cover 6 has a right-side first screw insert hole which is connected to the right-side first screw hole 150*a* and to which a screw 603*a* as a fastening member is inserted. The surface 601*a* also has a right-side first screw insert hole which is connected to the right-side second screw hole 150*b* and to which a screw 603*b* is inserted. As illustrated in FIG. 35, the right-side surface 601*a* of the inner cover unit 601 has a right-side third screw hole 611 which is connected to the right-side third screw hole 153*a* of the first cover attachment member 153 and to which a screw 603*c* is inserted. The screws 603*a* to 603*c* are inserted into these screw insert holes to screw the screws 603*a* to 603*c* into the screw holes, thereby the right side of the front cover 6 is fastened to the drawer unit front plate 150.

To sufficiently support the image reading unit 4 with using the structures of the apparatus body unit 5, it is necessary that the above-descried reinforcement frame 212 is extended up to a position opposed to the upper part of the right side surface of the front cover. However, if the above-described reinforcement frame 212 is extended up to the position opposed to the upper part of the right side surface of the front cover, the above-descried reinforcement frame 212 is opposed to the right-side third screw insert hole 611 for fastening the right upper part of the front cover 6 to the drawer unit 76. The following problem occurs in a configuration in which the reinforcement frame 212 is opposed to the right-side third screw insert hole 611, in a state where the drawer unit 76 is attached to the apparatus body unit 5. That is, the problem is that the front cover 6 is not possibly removed from the drawer unit 76, in a state where the drawer unit 76 is attached to the apparatus body unit 5. In another configuration to be considered, the upper part of the right side surface of the front cover is not fastened to the drawer unit 76. As a problem in this case, if the user holds the handle unit 6*a* of the front cover 6 to draw out the drawer unit 76, the right upper part of the front cover 6 deflects downward.

Figure 36:
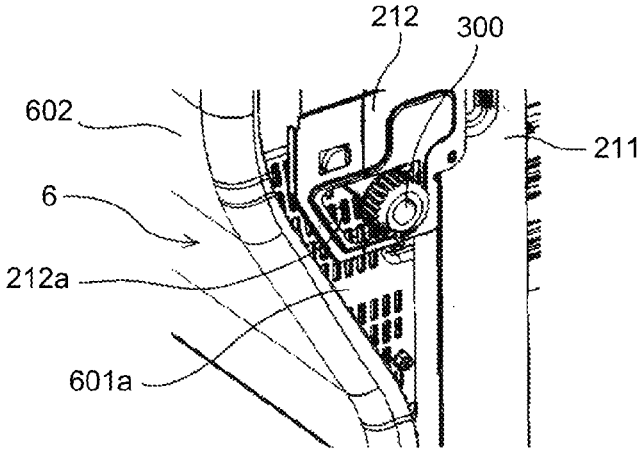
FIG. 36 is a perspective diagram illustrating a state where a tool is inserted from an opening of a reinforcement frame.

Thus, in this embodiment, as illustrated in FIG. 34, an opening 212*a* is formed in a position opposed to the right-side third screw insert hole 611 of the reinforcement frame 212. As illustrated in FIG. 36, a tool 300 is inserted from the opening 212*a* of the reinforcement frame, thereby accessing the screw 603*c* screwed to the right-side third screw hole, in a state where the drawer unit 76 is attached to the apparatus body unit 5. As a result, it is possible to access the screw 603*c* screwed to the right-side third screw hole, in a state where the drawer unit 76 is attached to the apparatus body unit 5, without deteriorating the strength of the structures of the apparatus body unit 5.

Removal of a non-illustrative right cover of the apparatus body unit 5 causes exposure of the three screws 603*a* to 603*c* for fastening the right side part of the front cover to the drawer unit, in a state where the drawer unit 76 is attached to the apparatus body unit 5. In a state where the drawer unit 76 is attached to the apparatus body unit 5, the right side part of the front cover can be removed from the drawer unit.

Figure 37:
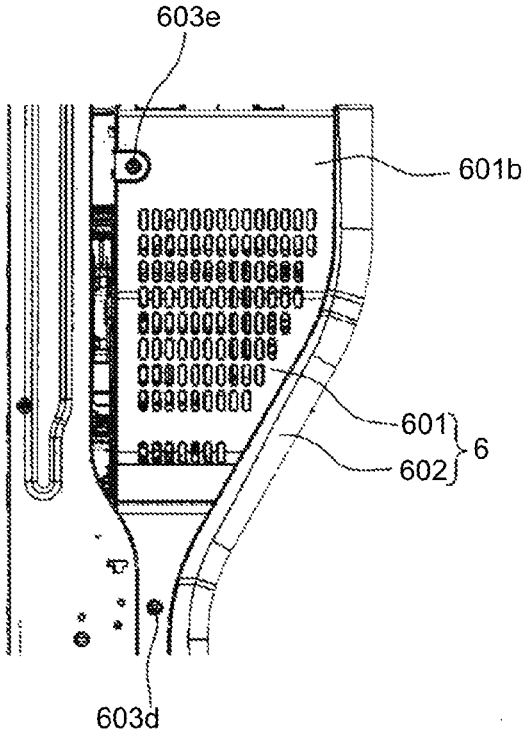
FIG. 37 is an enlarged diagram illustrating the vicinity of the front cover when the left cover of the apparatus body unit is removed.

FIG. 37 is an enlarged diagram illustrating the vicinity of the front cover, when a left-side cover of the apparatus body unit is removed. As illustrated in FIG. 37, a left-side surface

601*b* of the inner cover unit 601 of the front cover 6 has a left-side first screw insert hole which is connected to a non-illustrative left-side first screw hole and to which a screw 603*d* as a fastening member is inserted. The surface also has a left-side second screw insert hole which is connected to a non-illustrative left-side second screw hole and to which a screw 603*e* is inserted. The screws 603*d* and 603*e* are inserted into these screw insert holes to screw screws to the non-illustrative left-side screw holes, thereby fastening the left side of the front cover 6 to the drawer unit front plate 150.

Removal of the non-illustrative left-side cover of the apparatus body unit 5 causes exposure of the two screws 603*d* and 603*e* for fastening the left side part of the front cover to the drawer unit, in a state where the drawer unit 76 is attached to the apparatus body unit 5. Therefore, the left-side part of the front cover 6 can be removed from the drawer unit 76, in a state where the drawer unit 76 is attached to the apparatus body unit 5.

When the fastening of the front cover 6 to the drawer unit 76 is made only on the left and right sides, the following problem occurs. That is, when the user holds the handle unit 6*a* provided approximately at the center of the front cover 6, the front cover 6 may deflect. Specifically, the center part of the front cover 6 may protrude onto the side of the drawing direction. To prevent this problem, it is necessary that the center part of the front cover 6 be fastened to the drawer unit 76.

For a configuration for accessing a screw for fastening the center part of the front cover 6 to the drawer unit 76 in a state where the drawer unit 76 is attached to the apparatus body unit 5, the accessing is preferably made from the front side. If the screws are exposed on the front surface (as a design surface) of the apparatus, it results in unattractive appearance of the apparatus. In the configuration of this embodiment, therefore, the screws can be accessed from the handle unit 6*a* opened and provided approximately at the center of the front cover 6.

Figure 38:
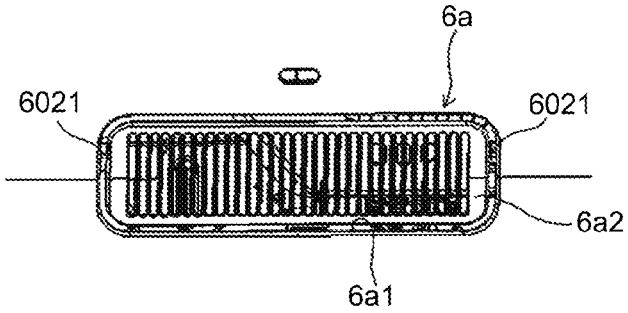
FIG. 38 is an enlarged diagram illustrating the periphery of a handle unit of the front cover.

FIG. 38 is an enlarged diagram illustrating the periphery of the handle unit 6*a* of the front cover 6.

As illustrated in FIG. 38, an outer cover unit 602 of the front cover 6 has the handle unit 6*a* having an opening 6*a*1 into which the user enters his/her hand. A flapper 6*a*2 is rotationally installed into the opening 6*a*1 of the handle unit 6*a*. The flapper 6*a*2 is pressed forcibly by a pressing member, such as a spring, in a direction opposed to the direction of rotation which is made at the time the user enters his/her hand into the opening 6*a*1 of the handle unit 6*a*. A non-illustrative pushing member is attached to one end part of rotating shafts 6021 provided on both ends of the flapper 6*a*2. In a state where the flapper 6*a*2 is closed, the pushing member comes up against a non-illustrative interlock switch, and pushes the non-illustrative interlock switch.

When the user intends to draw out the drawer unit and enters his/her hand into the opening 6*a*1 of the handle unit 6*a*, the flapper 6*a*2 is pushed and rotates in a direction opposed to the forcible pressing direction of the forcible pressing member. When the flapper 6*a*2 rotates, the non-illustrative pushing member separates away from the non-illustrative interlock switch, and the switch will be OFF. As a result, before the drawer unit 76 is drawn out, electricity is not (OFF) supplied from a fixing power source of the apparatus body unit 5 and a secondary transfer power source, thus preventing electrical short circuits.

Figure 39:
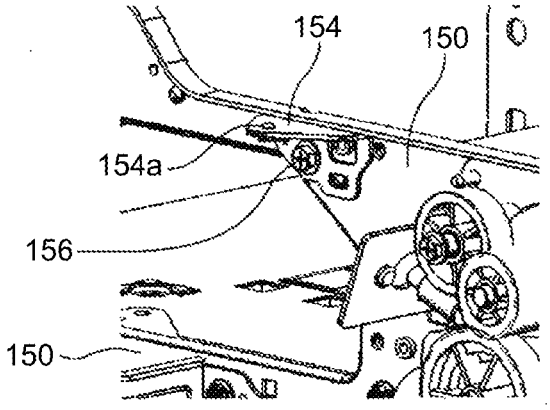
FIG. 39 is a perspective diagram illustrating a drawer unit front plate and a second cover attachment member.

As illustrated in FIG. 39, a second cover attachment member 154 is screwed to the upper part of the drawer unit front plate 150, using a screw 156. The second cover attachment member 154 has a horizontal surface. This horizontal surface has a central screw hole 154*a* to which the front cover 6 is screwed.

Figure 40:
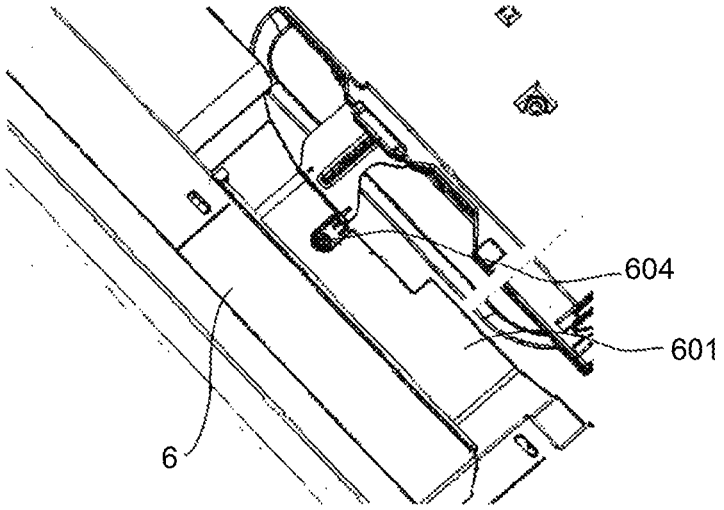
FIG. 40 is an enlarged perspective view, as seen from the top, illustrating the vicinity of the front cover of the drawer unit.

FIG. 40 is an enlarged perspective diagram, as seen from the top, illustrating the vicinity of the front cover of the drawer unit 76.

As illustrated in FIG. 40, the upper surface of the inner cover unit 601 of the front cover 6 has a central screw insert hole which is connected to the central screw hole 154*a* of the second cover attachment member 154 and into which a screw 604 is inserted. The screw 604 is inserted into the central screw insert hole, to screw the screw 604 to the central screw hole 154*a* of the second cover attachment member 154. As a result, the central part of the front cover 6 is fastened to the drawer unit front plate 150, through the second cover attachment member 154.

Figure 41:
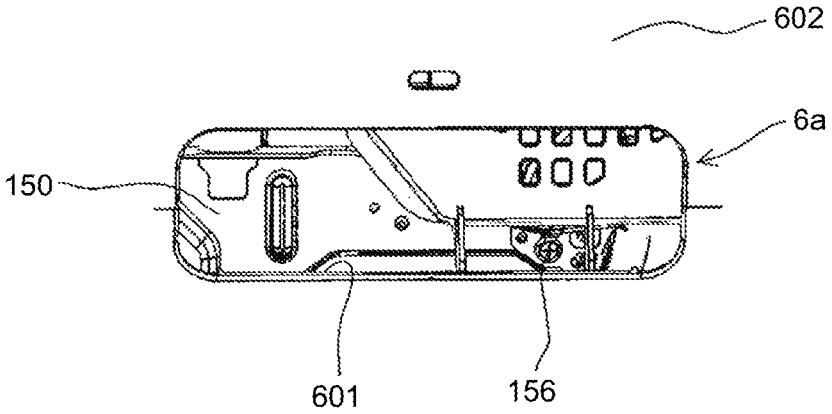
FIG. 41 is an enlarged block diagram illustrating the vicinity of the handle unit in a state where a flapper is removed.

FIG. 41 is an enlarged block diagram illustrating the vicinity of the handle unit 6*a* in a state where the flapper 6*a*2 is removed.

As illustrated in FIG. 41, the screw 156 is exposed from the opening 6*a*1 of the handle unit 6*a*. The screw 156 is used for screwing the second cover attachment member 154 to the drawer unit front plate 150. The above-described screw 156 is accessed from the opening 6*a*1 of the handle unit 6*a*, to remove the second cover attachment member 154 from the drawer unit front plate 150. This enables to remove the central part of the front cover 6 from the drawer unit 76.

Figure 42:
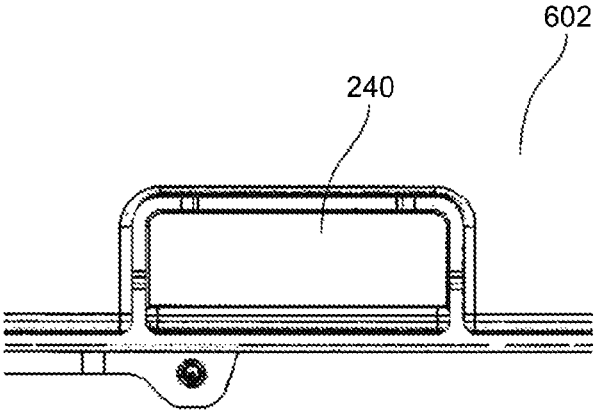
FIG. 42 is an enlarged block diagram illustrating the vicinity of an operation member of the front cover.

In this embodiment, the central part in the lateral direction of the lower part of the front cover 6 is also fastened to the drawer unit front plate 150 using a screw. As illustrated in FIG. 42, the screw for fixing the central part in the lateral direction of the lower part of the front cover is usually covered by an operation member 240 which is operated at removal of the sheet of paper stuck in the reversing carriage path 73.

Figure 43:
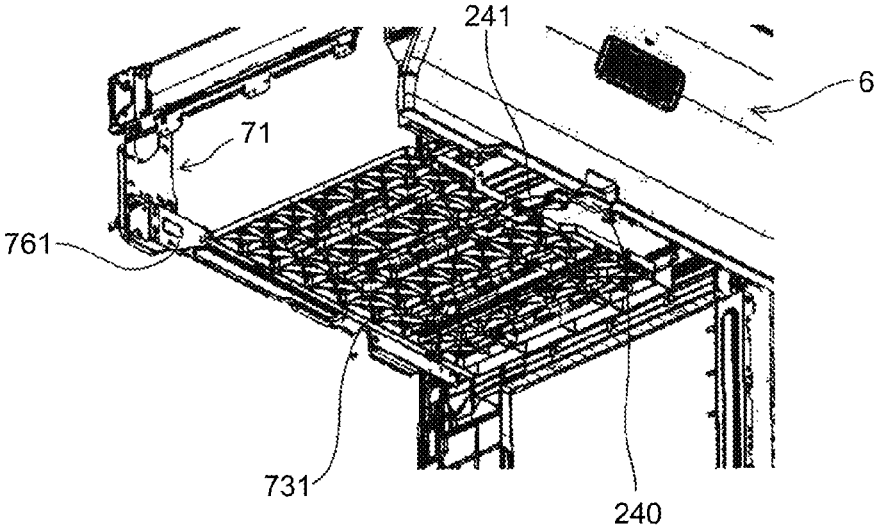
FIG. 43 is a perspective diagram, as seen from the bottom, of the drawer unit.
Figure 44:
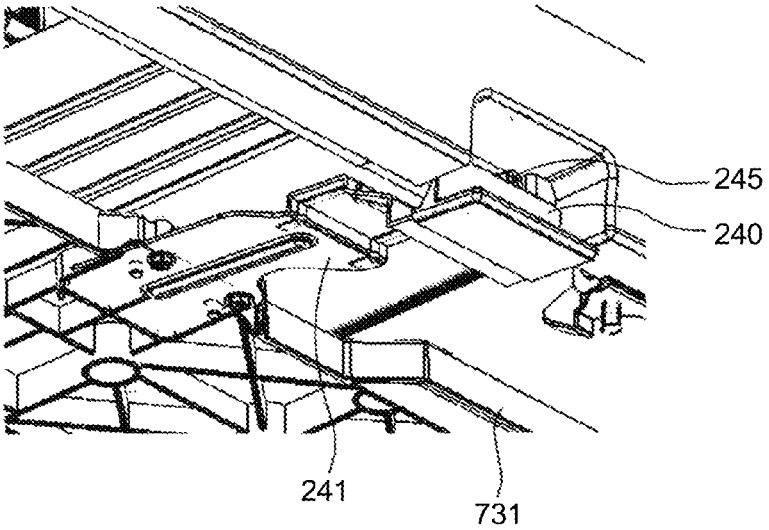
FIG. 44 is a perspective diagram, as seen from the bottom, illustrating the vicinity of the operation member of the drawer unit.

As illustrated in FIG. 43 and FIG. 44, the operation member 240 is attached to a guide member for reversing carriage rotationally supported by a rear frame 761 of the drawer unit 76, through an elastic member 241.

A non-illustrative magnet is provided on the lower surface of the drawer unit front plate 150. Normally, an elastic member 241 made of metal is attached to the above-described magnet. At removal of a sheet of paper remaining on the reversing carriage path 73, first, the drawer unit 76 is drawn out. Then, if the operation member 240 is moved downward, the elastic member 241 separates from the non-illustrative magnet, and a guide member for reversing carriage 731 is rotated about the rear frame 761 as a fulcrum. Now, the reversing carriage path 73 is exposed, thus enabling to remove the sheet of paper in the reversing carriage path 73. After removal of the sheet of paper, the operation member 240 is moved upward, and the elastic member 241 is attached to the non-illustrative magnet. Then, the drawer unit 76 is set to the apparatus body unit 5.

Figure 45:
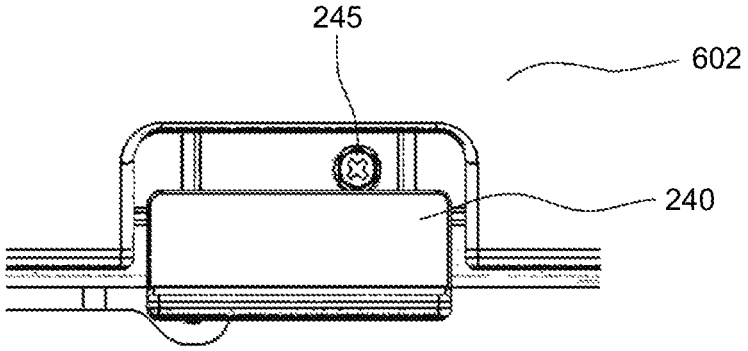
FIG. 45 is a diagram illustrating a state where the operation member is moved downward to cause exposure of the screw.

As illustrated in FIG. 45, if the operation member 240 is moved downward, a screw 245 covered by the operation member 240 is exposed. In this manner, normally, the screw 245 is covered by the operation member 240 as a covering member, thus preventing unattractive appearance of the front surface (as a design surface) of the front cover 6.

Figure 46:
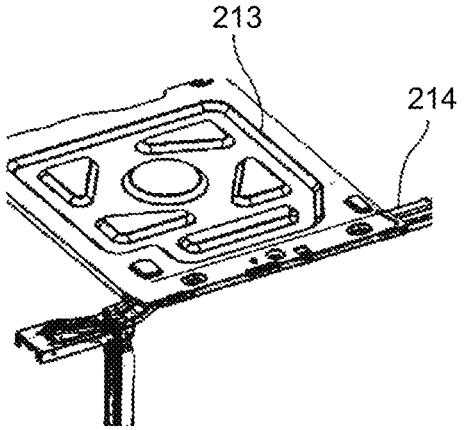
FIG. 46 is a perspective diagram illustrating a partition plate for partitioning the apparatus body unit and a sheet feeding unit.

In a state where the drawer unit 76 is attached to the apparatus body unit 5, the drawer unit 76 is opposed to a partition plate 213 which partitions the apparatus body unit 5 and the sheet feeding unit 3, as illustrated in FIG. 46. In a state where the drawer unit 76 is attached to the apparatus body unit, the lower surface of the drawer unit front plate 150 is opposed to a horizontal frame 214 supporting the partition plate 213.

Figure 47:
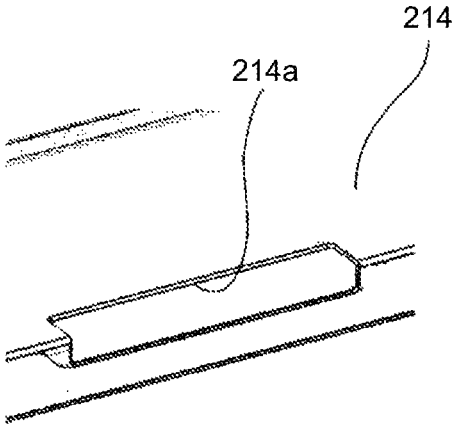
FIG. 47 is a perspective diagram illustrating a cutout of a horizontal frame.

If the operation member 240 is moved downward in a state where the drawer unit 76 is attached to the apparatus body unit, the elastic member 241 hits the horizontal frame 214, thus resulting in that the operation member 240 is not possibly moved downward until the screw 245 is exposed. In this embodiment, therefore, as illustrated in FIG. 47, a cutout 214*a* is provided in a position opposed to the elastic member 241 of the horizontal frame 214.

Figure 48:
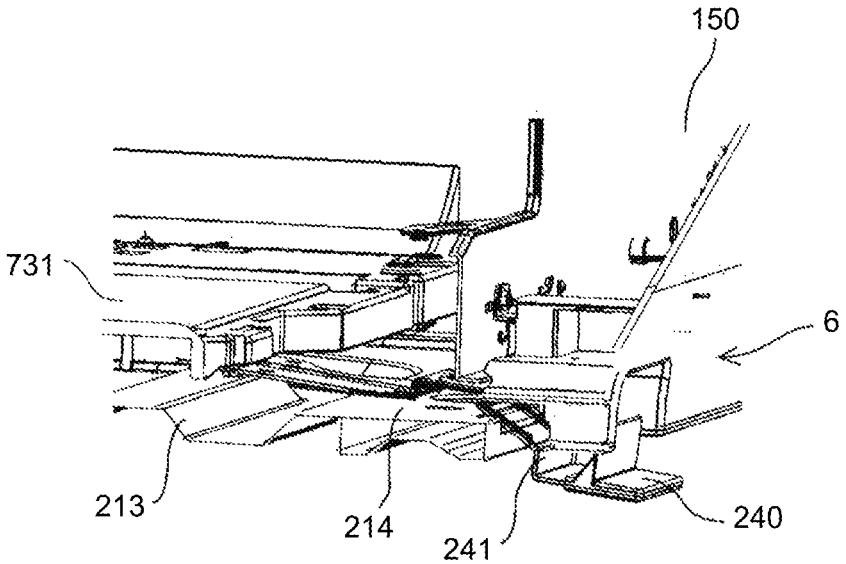
FIG. 48 is a diagram illustrating the situation in which the operation member is moved downward, in a state where the drawer unit is attached to the apparatus body.
Figure 49:
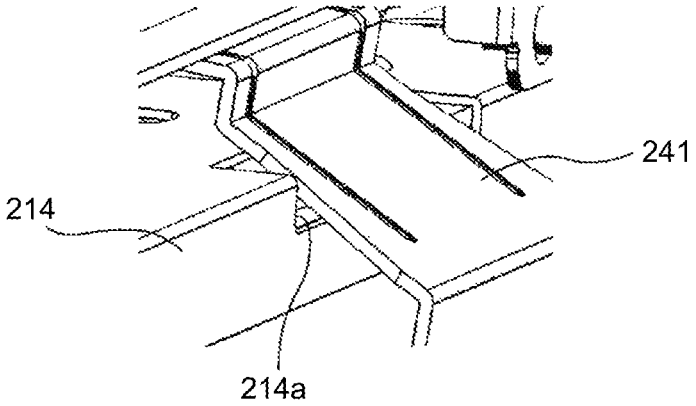
FIG. 49 is a diagram illustrating the relationship of an elastic member at the time the operation member is moved downward and the cutout of the horizontal frame, in a state where the drawer unit is attached to the apparatus body.
Figure 50:
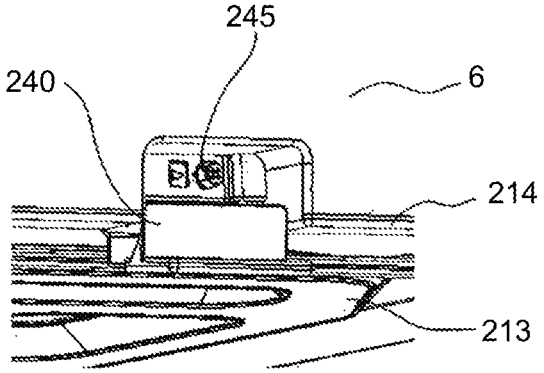
FIG. 50 is a perspective diagram illustrating the situation in which the screw is exposed, in a state where the drawer unit is attached to the apparatus body.

As illustrated in FIG. 48 and FIG. 49, by providing the cutout 214*a* in a position opposed to the elastic member 241 of the horizontal frame 214, the elastic member 241 enters the cutout 214*a*, if the operation member 240 is moved downward in a state where the drawer unit 76 is attached to the apparatus body unit. As illustrated in FIG. 50, the operation member 240 can be moved downward until the screw 245 is exposed, in a state where the drawer unit 76 is attached to the apparatus body. Therefore, in a state where the drawer unit 76 is attached to the apparatus body unit 5, the screw 245 can be accessed and also removed therefrom.

The operation member 240 can be retracted to a position where the screw 245 is exposed, due to elastic deformation of the elastic member 241. Accordingly, the operation member 240 can be retracted with a simple configuration of the elastic member, thus preventing an increase in costs.

Accordingly, in this embodiment, the fastening of the front cover 6 can entirely be released, in a state where the drawer unit 76 is attached. As a result, in a state where the drawer unit 76 is attached to the apparatus body unit 5, the front cover 6 can be removed from the drawer unit 76. This enables exposure of the drawer unit front plate 150, in a state where the drawer unit 76 is attached. Therefore, the driving unit 700 provided in the drawer unit front plate 150 can be accessed, and enabling to replace the damaged driving motor 701.

In this embodiment, the front cover 6 covering the front side of the apparatus body unit is attached to the drawer unit 76. However, it is not limited to this configuration. For example, in the front cover 6, only some part(s) covering the drawer unit and opposed to the front plate 150 of the drawer unit 76 may be fixed to the drawer unit 76, and may be drawn out from the apparatus body together with the drawer unit 76.

The descriptions made above are only one example. The present invention has some characteristic features in each of the following aspects.

Aspect 1

An image forming apparatus including a drawer unit 76, which is configured to include a carriage path for carrying a recording medium, such as a sheet of paper, and to be drawn out from an apparatus body, comprises: the drawer unit 76 which includes a lock unit (lock mechanism 160) locking the drawer unit 76 in the apparatus body and a driving unit (driving motor 701) including at least a driving source and driving the lock unit; and a drawer unit cover part (front cover 6 in this embodiment) which covers at least the drawer unit in an outer cover (front cover 6) of the apparatus body arranged on a front side in a drawing direction of the drawer unit 76, the cover part being attached to the drawer unit 76 in a manner that the drawer unit cover part is removed from the drawer unit 76 in a state where the drawer unit is attached to the apparatus body.

According to this configuration, as described in the embodiment, even if a driving source (driving motor 701) is damaged, the drawer unit 76 can be exposed, thus enabling to replace the driving source.

According to a following configuration, the damaged driving source can be replaced. That is, a unit for manually releasing the lock can be provided in a position where it is exposed when the outer cover is removed. As a result, even if the drawer unit is not possibly drawn out from the apparatus body due to the damaged driving source, it is possible to expose the unit for manually releasing the lock by removal of the outer cover. The lock is released by operating the exposed unit for manually releasing the lock, thereby drawing the drawer unit from the apparatus body. In addition, the drawer unit is drawn out from the drawn out from the apparatus body, thereby exposing the driving source provided in the drawer unit and replacing the driving source.

Aspect 2

In Aspect 1, the driving source (driving motor 701) is provided in a position to be exposed when the drawer unit cover part (front cover 6) is removed.

According to this configuration, if the drawer unit cover part, such as the front cover, is removed, the driving source, such as the driving motor 701 can be exposed, thereby replacing the driving source.

Aspect 3

In Aspect 1 or Aspect 2, the drawer unit cover part (front cover 6) has a front part which is orthogonal to the drawing direction of the drawer unit and side surface parts (right side surface and left side surface in this embodiment) which are parallel to the drawing direction on both ends of the front part, and includes a fastening unit for fastening the drawer unit 76 to the side surface parts.

According to this configuration, as described in the embodiment, it is possible to remove the drawer unit cover part of the outer cover from the drawer unit 76, in a state where the drawer unit 76 is attached to the apparatus body, without resulting in unattractive appearance of the front part of the outer cover, as a design surface of the apparatus.

Aspect 4

In any of Aspects 1 to 3, the drawer unit cover part is fastened to the drawer unit with a plurality of fastening members; and an opening 212*a* is provided in a position opposed to the fastening members (screw) of structures of the apparatus body (reinforcement frame 212).

According to this configuration, as described in the embodiment, a tool is inserted from the opening 212*a*, thereby accessing the fastening member, such as a screw. As a result, the drawer unit cover part can be removed from the drawer unit 76, in a state where the drawer unit 76 is attached to the apparatus body.

Aspect 5

In any of Aspects 1 to 4, the drawer unit cover part (front cover 6) is fastened to the drawer unit 76 with a plurality of fastening members (screw); the drawer unit cover part has a handle unit 6*a* which is open in which a user's hand is put for drawing out the drawer unit 76; and at least one of the plurality of fastening members can be accessed from the opening 6*a*1 of the handle unit.

According to this configuration, as described in the embodiment, the fastening member, such as a screw, can be accessed, in a state where the drawer unit 76 is attached to the apparatus body, without resulting in unattractive appearance of the apparatus. The vicinity of the handle unit 6*a* can be fastened using a fastening member. This results in preventing deflection of the drawer unit cover part when the user holds the handle unit 6*a* to draw out the drawer unit.

Aspect 6

In any of Aspects 1 to 5, the drawer unit cover part (front cover 6) is fastened to the drawer unit 76 with a plurality of fastening members, and has a cover member (operation member 240) for covering the fastening member; and at least one of the plurality of fastening members can be accessed by an operation on the cover member.

According to this configuration, as described above, it is possible to access the fastening member, such as a screw, without resulting in unattractive appearance of the apparatus, in a state where the drawer unit 76 is attached to the apparatus body.

Aspect 7

In Aspect 6, the cover member (operation member 240) is attached to the drawer unit 76 through an elastic member 241, and configured to be moved to a retraction position for exposing the fastening member from a position for covering the fastening member (screw) due to elastic deformation of the elastic member 241.

According to this configuration, as described above, the operation member 240 can be retracted with a simple configuration, thus preventing an increase in costs.

Aspect 8

In Aspect 6 or Aspect 7, the cover member is an operation member 240 which is operable by a user at removal of the recording medium in the drawer unit.

Aspect 9

In any of Aspects 1 to 8, a body side lock unit (lock receiving surface 182, 182*b*), in contact with the lock unit (lock mechanism 160) from a back side in the drawing direction when the drawer unit 76 is locked in the apparatus body, is provided on a side of the drawer unit than a back side plate of the apparatus body (body rear plate 501) arranged on the back side in the drawing direction of the drawer unit 76.

According to this configuration, it is possible to prevent the lock unit, such as the lock mechanism 160, from protruding to the back side than the back plate, such as the body rear plate 501, when the drawer unit 76 is locked. As a result, there is no restriction in the arrangement of the part, such as the secondary transfer roller provided on the back side than the back plate. The unit provided on the back side than the back plate, such as the secondary transfer driving unit 800 can be provided to be opposed to the body-side lock unit, such as the lock receiving surfaces 182*a* and 182*b*. This can enhance the degree of freedom in the arrangement of the parts provided on the back side than the back plate, such as the secondary transfer driving unit 800, and achieve miniaturization of the apparatus.

Aspect 10

In Aspect 9, when the drawer unit locked in the apparatus body, the lock unit is configured not to protrude from the back plate.

According to this configuration, as described in the embodiment, it is possible to enhance the degree of freedom in the arrangement of parts provided on the back side than the back plate, such as the secondary transfer driving unit 800, and achieve miniaturization of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a drawer unit configured to be drawn out from a body of the image forming apparatus, the drawer unit includes:

a carriage path for carrying a recording medium, a lock unit configured to lock the drawer unit in the body, a driving unit configured to drive the lock unit, the driving unit including at least a driving source, and a drawer unit cover configured to cover at least the drawer unit, the drawer unit cover being a part of an outer cover of the body arranged on a side in a drawing direction of the drawer unit, the drawer unit cover being attached to the drawer unit so that the drawer unit cover is removed from the drawer unit in a state where the drawer unit is attached to the body, wherein the driving source is provided in a position to be exposed when the drawer unit cover part is removed.

2. The image forming apparatus according to claim 1, wherein the drawer unit cover has a front part that is orthogonal to the drawing direction of the drawer unit and side surface parts that are parallel to the drawing direction on both ends of the front part, and includes a fastening unit for fastening the drawer unit to the side surface parts.

3. The image forming apparatus according to claim 1, wherein the drawer unit cover is configured to be fastened to the drawer unit with a plurality of fastening members, and an opening is provided in the body, the position being opposed to the fastening members.

4. The image forming apparatus according to claim 1, wherein the drawer unit cover is configured to be fastened to the drawer unit with a plurality of fastening members;

the drawer unit cover has a handle unit having an opening in which a user's hand is put for drawing out the drawer unit, and at least one of the fastening members is configured to be accessed from the opening of the handle unit.

5. The image forming apparatus according to claim 1, wherein the drawer unit cover part is configured to be fastened to the drawer unit with a plurality of fastening members, and has a cover member for covering the fastening member, and at least one of the fastening members is configured to be accessed by an operation of an operating member on the cover member.

6. The image forming apparatus according to claim 5, wherein the cover member is configured to be attached to the drawer unit through an elastic member so that the cover member is moved to a retraction position for exposing the fastening member from a position for covering the fastening member, due to elastic deformation of the elastic member.

7. The image forming apparatus according to claim 5, wherein the cover member is an operation member that is operable by a user at removal of the recording medium in the drawer unit.

8. The image forming apparatus according to claim 1, wherein the lock unit includes a body side lock unit in contact with the lock unit from a back side in the drawing direction when the drawer unit is locked in the body, the body side lock unit being provided closer to a side of the drawer unit than a back side plate of the body arranged on the back side in the drawing direction.

9. The image forming apparatus according to claim 8, wherein the lock unit is configured not to protrude from the back side plate when the drawer unit is locked in the body.

10. An image forming apparatus, comprising:

a drawer unit configured to be drawn out from a body of the image forming apparatus, the drawer unit includes:

a carriage path for carrying a recording medium, a lock unit configured to lock the drawer unit in the body, a driving unit configured to drive the lock unit, the driving unit including at least a driving source, and a drawer unit cover configured to cover at least the drawer unit, the drawer unit cover being a part of an outer cover of the body arranged on a side in a drawing direction of the drawer unit, the drawer unit cover being attached to the drawer unit so that the drawer unit cover is removed from the drawer unit in a state where the drawer unit is attached to the body, wherein:

the drawer unit cover is configured to be fastened to the drawer unit with a plurality of fastening members;

the drawer unit cover has a handle unit having an opening in which a user's hand is put for drawing out the drawer unit, and at least one of the fastening members is configured to be accessed from the opening of the handle unit.

11. An image forming apparatus, comprising:

a drawer unit configured to be drawn out from a body of the image forming apparatus, the drawer unit includes:

a carriage path for carrying a recording medium, a lock unit configured to lock the drawer unit in the body, a driving unit configured to drive the lock unit, the driving unit including at least a driving source, and a drawer unit cover configured to cover at least the drawer unit, the drawer unit cover being a part of an outer cover of the body arranged on a side in a drawing direction of the drawer unit, the drawer unit cover being attached to the drawer unit so that the drawer unit cover is removed from the drawer unit in a state where the drawer unit is attached to the body, wherein:

the drawer unit cover part is configured to be fastened to the drawer unit with a plurality of fastening members, and has a cover member for covering the fastening member, and at least one of the fastening members is configured to be accessed by an operation of an operating member on the cover member.

* * * * *